US007669583B2

(12) United States Patent
Moriya

(10) Patent No.: US 7,669,583 B2
(45) Date of Patent: Mar. 2, 2010

(54) INTERNAL COMBUSTION ENGINE CONTROL APPARATUS

(75) Inventor: Hidenori Moriya, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 267 days.

(21) Appl. No.: 11/915,213

(22) PCT Filed: Jul. 26, 2006

(86) PCT No.: PCT/JP2006/315250

§ 371 (c)(1),
(2), (4) Date: Nov. 21, 2007

(87) PCT Pub. No.: WO2007/013663

PCT Pub. Date: Feb. 1, 2007

(65) Prior Publication Data

US 2009/0159046 A1 Jun. 25, 2009

(30) Foreign Application Priority Data

Jul. 29, 2005 (JP) ..... 2005-221160

(51) Int. Cl.
*F02P 5/153* (2006.01)

(52) U.S. Cl. ..... 123/406.22; 123/406.41; 123/406.42; 123/435; 73/114.16; 73/114.17

(58) Field of Classification Search ..... 123/406.22, 123/406.41, 406.42, 406.43, 435; 73/114.16, 73/114.17

See application file for complete search history.

(56) References Cited

U.S. PATENT DOCUMENTS

| | | | | |
|---|---|---|---|---|
| 5,474,045 | A | 12/1995 | Demizu et al. | |
| 6,089,077 | A * | 7/2000 | Daniels | 73/35.08 |
| 7,171,950 | B2 * | 2/2007 | Palma et al. | 123/435 |
| 7,212,909 | B2 * | 5/2007 | Yoshino et al. | 701/111 |
| 2003/0188571 | A1 * | 10/2003 | Wright | 73/115 |
| 2005/0022789 | A1 * | 2/2005 | Palma et al. | 123/435 |
| 2005/0197762 | A1 * | 9/2005 | Yoshino et al. | 701/111 |
| 2005/0251322 | A1 * | 11/2005 | Wang et al. | 701/114 |
| 2007/0181096 | A1 * | 8/2007 | Wagner et al. | 123/299 |
| 2007/0250251 | A1 * | 10/2007 | Green et al. | 701/105 |
| 2009/0159046 | A1 * | 6/2009 | Moriya | 123/435 |

FOREIGN PATENT DOCUMENTS

| | | |
|---|---|---|
| EP | 1 106 805 | 6/2001 |
| EP | 1 477 651 | 11/2004 |
| JP | 2005-30332 | 2/2005 |

* cited by examiner

*Primary Examiner*—Erick Solis
(74) *Attorney, Agent, or Firm*—Oblon, Spivak, McClelland, Maier & Neustadt, L.L.P.

(57) ABSTRACT

An internal combustion engine control apparatus includes an in-cylinder pressure sensor for detecting in-cylinder pressure. A combustion start time and combustion end time, which are parameters serving as control indexes for an internal combustion engine, are determined in accordance with ignition timing. Information about a heat release amount is acquired in accordance with the in-cylinder pressures that are measured at two points by the in-cylinder pressure sensor. The in-cylinder pressure is estimated in accordance with a relationship among the heat release amount information, control index parameters, and in-cylinder pressure.

22 Claims, 16 Drawing Sheets

INTERNAL COMBUSTION ENGINE CONTROL APPARATUS

TECHNICAL FIELD

The present invention relates to an internal combustion engine control apparatus, and more particularly to a control apparatus suitable for use with an internal combustion engine that uses an in-cylinder pressure value to exercise various control functions.

BACKGROUND ART

A conventional internal combustion engine control apparatus disclosed, for instance, by Patent Document 1 corrects a fuel injection amount in accordance with a control parameter $P(\theta)\times V^{\kappa}(\theta)$. This control parameter is obtained as a product of in-cylinder pressure $P(\theta)$ and the value $V^{\kappa}(\theta)$, which is obtained by exponentiating in-cylinder volume $V^{\kappa}(\kappa)$ by specific heat ratio K. More specifically, the apparatus calculates the control parameter $P(\theta)\times V^{\kappa}(\theta)$ for each of two predetermined crank angles, and determines a correction value for the fuel injection amount in accordance with the difference between the two calculated control parameters. The disclosed conventional technology assumes that there is a correlation between the control parameter $P(\theta)\times V^{\kappa}(\theta)$ and the change pattern of a heat release amount Q in an internal combustion engine cylinder. The conventional technology makes it possible to easily exercise highly accurate and responsive engine control in which the heat release amount Q in a cylinder is reflected.

Including the above-mentioned document, the applicant is aware of the following document as a related art of the present invention.

[Patent Document 1] Japanese Patent Laid-open No. 2005-30332

DISCLOSURE OF INVENTION

The information (e.g., record) concerning the internal combustion engine in-cylinder pressure $P(\theta)$ is an effective parameter for combustion information acquisition. However, the calculation formula for determining the parameter is complicated. Therefore, the parameter cannot easily be calculated by a present-day vehicle-mounted computer (ECU). Further, high-speed sampling must be conducted to calculate the in-cylinder pressure with high accuracy. In reality, however, such calculations are extremely difficult because the computation load is heavy.

According to the above conventional technology, the combustion information, which correlates to the change pattern of the heat release amount Q, can be acquired as described above in accordance with the control parameter $P(\theta)\times V^{\kappa}(\theta)$ for two predetermined crank angles. This conventional technology would be at an advantage if it can easily estimate the information about the internal combustion engine in-cylinder pressure $P(\theta)$ by using only two data points. If the information (e.g., record) concerning the in-cylinder pressure $P(\theta)$ could be estimated with high accuracy, the resulting value might be used to perform various combustion analysis calculations or exercise applicative engine control. However, the above conventional technology cannot estimate the in-cylinder pressure $P(\theta)$ and needs further improvement.

The present invention has been made to solve the above problem. It is an object of the present invention to provide a control apparatus that is capable of estimating the in-cylinder pressure information about an internal combustion engine with ease and high accuracy and controlling the internal combustion engine in an ideal manner.

The above object is achieved by an internal combustion engine control apparatus which includes heat release amount information acquisition means for acquiring heat release amount information about an internal combustion engine. Relationship information acquisition means is provided for acquiring relationship information that defines the relationship among the heat release amount information, a predetermined parameter that serves as a control index for the internal combustion engine, and in-cylinder pressure. Pressure estimation means is also provided for estimating the in-cylinder pressure in accordance with the relationship information.

In a second aspect of the present invention, the predetermined parameter, which serves as a control index, may be at least one of a combustion start time, a combustion end time, and a combustion speed.

The above object is achieved by an internal combustion engine control apparatus which includes heat release amount information acquisition means for acquiring heat release amount information about an internal combustion engine. Combustion ratio information acquisition means is provided for acquiring in-cylinder combustion ratio information about the internal combustion engine. Relationship information acquisition means is also provided for acquiring relationship information that defines the relationship among the heat release amount information, the combustion ratio information, and in-cylinder pressure. Pressure estimation means is also provided for estimating the in-cylinder pressure in accordance with the relationship information.

In a fourth aspect of the present invention, the combustion ratio information acquisition means may acquire the combustion ratio information in accordance with a Weibe function that contains a combustion start time, a combustion end time, and a combustion speed.

The fifth aspect of the present invention may include in-cylinder pressure detection means for detecting in-cylinder pressure. The heat release amount information acquisition means may acquire the heat release amount information in accordance with in-cylinder pressures measured at least two crank angles. The relationship information may be defined in accordance with the relationship between the heat release amount information and the Weibe function. The pressure estimation means may estimate in-cylinder pressure at a crank angle other than the at least two crank angles.

The sixth aspect of the present invention may include ion detection means for detecting ions that are generated in a cylinder during combustion. The combustion ratio acquisition means may acquire the combustion ratio information in accordance with a value of the detected ions.

In a seventh aspect of the present invention, the heat release amount information acquisition means may acquire heat release amount information in accordance with the information about an in-cylinder filled air amount; and wherein the relationship information is defined in accordance with the value of the detected ions and the heat release amount information.

The eighth aspect of the present invention may include combustion information estimation means for estimating a heat release rate and/or indicated torque in accordance with an in-cylinder pressure value estimated by the pressure estimation means.

In a ninth aspect of the present invention, the internal combustion engine may be controlled in accordance with at least one of the in-cylinder pressure estimated by the pressure estimation means, the heat release rate estimated by the combustion information estimation means, and the indicated torque estimated by the combustion information estimation means.

In a tenth aspect of the present invention, at least one of ignition timing control, fuel injection control, valve opening characteristics control, and torque control may be included in the internal combustion engine control.

The eleventh aspect of the present invention may include in-cylinder pressure detection means for detecting in-cylinder pressure. Knock information acquisition means may also be provided for comparing an in-cylinder pressure value estimated by the pressure estimation means against an in-cylinder pressure value measured by the in-cylinder pressure detection means, and acquiring the information about knocking.

The twelfth aspect of the present invention may include estimated heat release rate acquisition means for acquiring an estimated heat release rate value in accordance with the estimated in-cylinder pressure value. Actual heat release rate acquisition means may also be provided for acquiring a measured heat release rate value in accordance with the measured in-cylinder pressure value. Knock information acquisition means may also be provided for comparing the estimated heat release rate value against the measured heat release rate value and acquiring the information about knocking.

In a thirteenth aspect of the present invention, the knock information acquisition means may acquire the information about knocking when the internal combustion engine's load factor is relatively high.

The fourteenth aspect of the present invention may include pressure record acquisition means for acquiring a record of in-cylinder pressure that is estimated by the pressure estimation means during the same combustion cycle. Maximum pressure value generation time acquisition means may also be provided for acquiring the time for invoking the maximum in-cylinder pressure value from the record of the estimated in-cylinder pressure. Ignition timing control means may also be provided for controlling ignition timing so that the time for invoking the maximum value coincides with the time for invoking the maximum in-cylinder pressure in a situation where the ignition timing is adjusted for the MBT.

The fifteenth aspect of the present invention may include pressure record acquisition means for acquiring a record of in-cylinder pressure that is estimated by the pressure estimation means during the same combustion cycle. Maximum pressure value information acquisition means may also be provided for acquiring the information about the maximum in-cylinder pressure from the record of the estimated in-cylinder pressure. Air-fuel ratio control means may also be provided for exercising control so as to provide a lean or rich air-fuel ratio in accordance with the information about the maximum in-cylinder pressure.

The sixteenth aspect of the present invention may include pressure record acquisition means for acquiring a record of in-cylinder pressure that is estimated by the pressure estimation means during the same combustion cycle. An in-cylinder pressure sensor may also be provided for detecting in-cylinder pressure. Distortion detection means may also be provided for comparing the record of the estimated in-cylinder pressure against a record of in-cylinder pressure measured by the in-cylinder pressure detection means, and acquiring distortion from the record of measured in-cylinder pressure. Sensor output correction means may also be provided for correcting the output of the in-cylinder pressure sensor in accordance with the distortion.

The seventeenth aspect of the present invention may include pressure record acquisition means for acquiring a record of in-cylinder pressure that is estimated by the pressure estimation means during the same combustion cycle. An in-cylinder pressure sensor may also be provided for detecting in-cylinder pressure. Distortion detection means may also be provided for comparing the record of the estimated in-cylinder pressure against a record of in-cylinder pressure measured by the in-cylinder pressure detection means, and acquiring distortion from the record of measured in-cylinder pressure. Sensor deterioration judgment means may also be provided for determining according to the distortion whether the in-cylinder pressure sensor is deteriorated.

The eighteenth aspect of the present invention may include control basic data selection means for selecting in-cylinder pressure estimated by the pressure estimation means as an in-cylinder pressure value for use as a basis for internal combustion engine control when the engine speed is relatively high.

The above object is achieved by an internal combustion engine control apparatus which includes required torque acquisition means for acquiring torque required for an internal combustion engine. Heat release amount information acquisition means is provided for acquiring heat release amount information about the internal combustion engine. Relationship information acquisition means is also provided for acquiring relationship information that defines the relationship among the heat release amount information, a predetermined parameter that serves as a control index for the internal combustion engine, and in-cylinder pressure. Control index determination means is also provided for defining the predetermined parameter, which serves as a control index, in accordance with the required torque and the relationship information.

The twentieth aspect of the present invention may include required in-cylinder pressure acquisition means for acquiring required in-cylinder pressure that corresponds to the required torque. The control index determination means may define the predetermined parameter, which serves as a control index, in accordance with the required in-cylinder pressure and the relationship information.

In a twenty-first aspect of the present invention, the predetermined parameter, which serves as a control index, may be at least one of a combustion start time, a combustion end time, and a combustion speed.

The twenty-second aspect of the present invention may include control means for controlling at least either a valve overlap amount or ignition timing in accordance with the predetermined parameter, which is defined by the control index determination means and used as a control index.

According to the first aspect of the present invention, the in-cylinder pressure information about an internal combustion engine can be estimated with ease and high accuracy in accordance with the relationship information that defines the relationship among the heat release amount information, the predetermined parameter that serves as a control index for the internal combustion engine, and in-cylinder pressure.

According to the second aspect of the present invention, combustion information that is necessary for in-cylinder pressure estimation can be appropriately defined.

According to the third aspect of the present invention, the in-cylinder pressure information about the internal combustion engine can be estimated with ease and high accuracy in accordance with the relationship information that defines the relationship among the heat release amount information, combustion ratio information, and in-cylinder pressure.

According to the fourth aspect of the present invention, an accurate combustion ratio can be acquired in accordance with the Weibe function that contains a combustion start time, a combustion end time, and a combustion speed.

According to the fifth aspect of the present invention, the in-cylinder pressure prevailing during a combustion period can be estimated by measuring the in-cylinder pressure at least two points.

According to the sixth aspect of the present invention, the combustion ratio information can be acquired in accordance with the ions generated in a cylinder during combustion and without having to measure the in-cylinder pressure.

According to the seventh aspect of the present invention, the relationship information for estimating the in-cylinder pressure can be acquired in accordance with the value of the detected ions and the heat release amount information based on the in-cylinder filled air amount.

According to the eighth aspect of the present invention, the in-cylinder pressure estimated by the first or third aspect of the present invention can be used to estimate the heat release rate or indicated torque with ease and high accuracy.

According to the ninth aspect of the present invention, the internal combustion engine can be controlled in accordance with an estimated value of at least one of the in-cylinder pressure, heat release rate, and indicated torque without imposing an excessive load on an ECU.

According to the tenth aspect of the present invention, at least one of ignition timing, fuel injection, valve opening characteristics, and torque can be controlled in accordance with an estimated value of at least one of the in-cylinder pressure, heat release rate, and indicated torque without imposing an excessive load on the ECU.

According to the eleventh aspect of the present invention, the estimated in-cylinder pressure and actual in-cylinder pressure for the same combustion cycle can be compared. Therefore, the information about knocking can be acquired with higher accuracy than during the use of the conventional method of estimating a normal in-cylinder pressure for the current combustion cycle from a phenomenon encountered during the preceding combustion cycle or from statistics.

According to the twelfth aspect of the present invention, the estimated heat release rate and actual heat release rate for the same combustion cycle can be compared. Therefore, the information about knocking can be acquired with higher accuracy than during the use of the conventional method of estimating a normal heat release rate for the current combustion cycle from a phenomenon encountered during the preceding combustion cycle or from statistics.

According to the thirteenth aspect of the present invention, the accurate information about knocking can be acquired within a high load region where knocking is likely to occur and without imposing an excessive load on the ECU.

According to the fourteenth aspect of the present invention, control can be exercised to adjust the ignition timing for the MBT without requiring the ECU to exhibit a high-speed sampling capability.

According to the fifteenth aspect of the present invention, control can be exercised to provide the leanest air-fuel ratio without requiring the ECU to exhibit a high-speed sampling capability.

According to the sixteenth or seventeenth aspect of the present invention, the estimated in-cylinder pressure and actual in-cylinder pressure for the same combustion cycle can be compared. Therefore, a sensor error can be determined with higher accuracy than during the use of the conventional method of estimating a normal in-cylinder pressure for the current combustion cycle from a phenomenon encountered during the preceding combustion cycle or from statistics.

According to the eighteenth aspect of the present invention, the load imposed on the ECU can be reduced within a region where the engine speed NE is high.

According to the nineteenth aspect of the present invention, control can be exercised according to the required torque and relationship information so that the torque of the internal combustion engine coincides with the desired required torque.

According to the twentieth aspect of the present invention, the predetermined parameter, which serves as a control index for the internal combustion engine, can be defined in accordance with the relationship information and the required in-cylinder pressure corresponding to the required torque.

According to the twenty-first aspect of the present invention, the combustion information required for controlling the internal combustion engine in accordance with the required torque can be appropriately defined.

According to the twenty-second aspect of the present invention, the relationship information can be used to exercise torque (combustion) control in accordance with the desired required torque. This aspect of the present invention also makes it possible, for instance, to control the valve overlap amount and ignition timing without making the intake air amount excessive or insufficient and without retarding the ignition timing.

BEST MODE FOR CARRYING OUT THE INVENTION

FIRST EMBODIMENT

[System Configuration Description]

Figure 1:
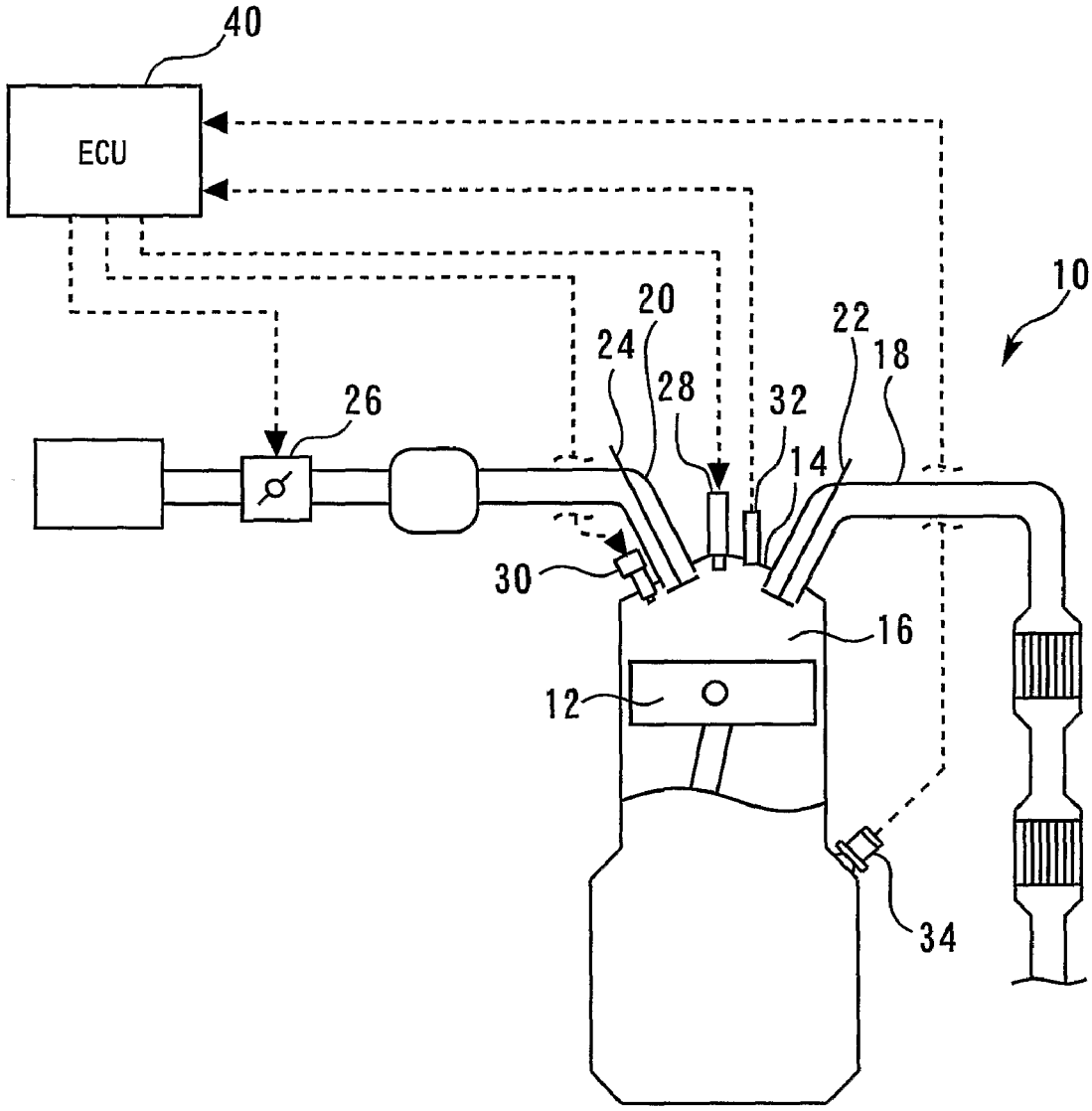
FIG. 1 illustrates the configuration of a first embodiment of the present invention.

FIG. 1 illustrates the configuration of a first embodiment of the present invention. As shown in FIG. 1, the system according to the present embodiment includes an internal combustion engine 10. A cylinder in the internal combustion engine 10 is provided with a piston 12 that reciprocates within the cylinder. The internal combustion engine 10 also includes a cylinder head 14. A combustion chamber 16 is formed between the piston 12 and cylinder head 14. The combustion chamber 16 communicates with an intake path 18 and an exhaust path 20. The intake path 18 and exhaust path 20 are provided with an intake valve 22 and an exhaust valve 24, respectively. The intake path 18 is also provided with a throttle valve 26. The throttle valve 26 is an electronically controlled throttle valve that is capable of controlling a throttle opening independently of an accelerator opening.

The cylinder head 14 is provided with an ignition plug 28, which protrudes into the combustion chamber 16 from a vertex of the combustion chamber 16. The cylinder head 14 is also provided with a fuel injection valve 30, which injects fuel into the cylinder. The cylinder head 14 incorporates an in-cylinder pressure sensor 32, which detects in-cylinder pressure P. Further, the internal combustion engine 10 has a crank angle sensor 34, which is positioned near a crankshaft to detect an engine speed NE.

In the internal combustion engine 10, the intake valve 22 and exhaust valve 24 are driven by an intake variable valve mechanism (not shown) and exhaust variable valve mechanism (not shown), respectively. Both of these variable valve mechanisms include a variable valve timing (VVT) mechanism, which can change the phase of the intake valve 22 or exhaust valve 24 within a predefined range.

The system shown in FIG. 1 includes an ECU (Electronic Control Unit) 40. The ECU 40 is connected to the aforementioned sensors and actuators. The ECU 40 is capable of controlling the operating state of the internal combustion engine 10 in accordance with the outputs of such sensors.

A method for estimating the information (record) about the in-cylinder pressure Pc, which is used in the present embodiment, will now be described with reference to FIGS. 2 and 3.

Figure 2:
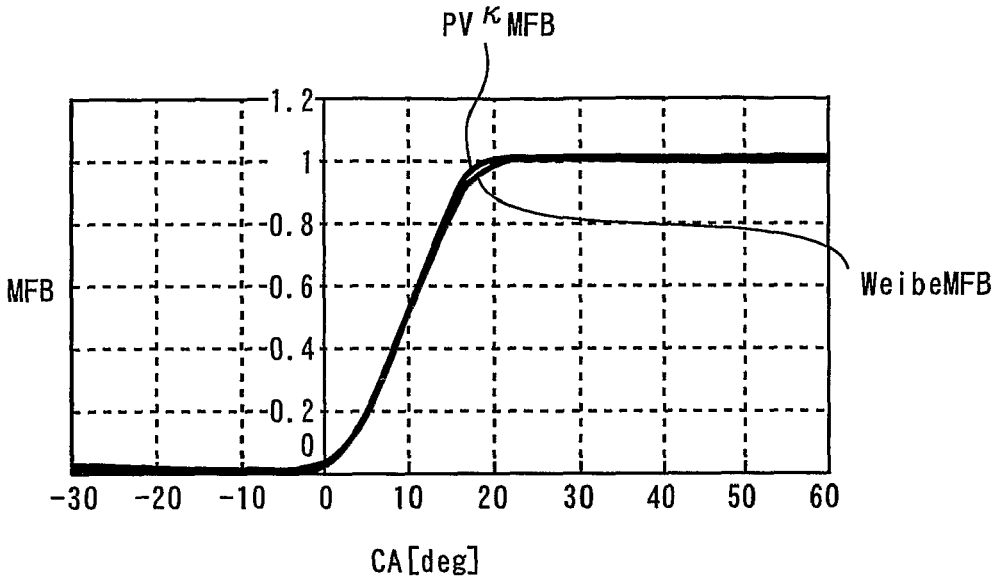
FIG. 2 is depicts the waveform of an in-cylinder combustion ratio MFB in relation to a crank angle θ.

FIG. 2 depicts the waveform of an in-cylinder combustion ratio MFB in relation to a crank angle θ. In this figure, the combustion ratio MFB is defined as an index that indicates the progress of combustion. More specifically, the combustion ratio MFB varies within a range of 0 to 1. An MFB of 0 represents a combustion start time, whereas an MFB of 1 represents a combustion end time.

The waveform designated "$PV^{\kappa}$MFB" in FIG. 2 represents a combustion ratio MFB that is calculated by a formula based on the $PV^{\kappa}$ method, that is, the following equation (Equation 1):

$$MFB=(P_{\theta}V_{\theta}^{\kappa}-P_{\theta 0}V_{\theta 0}^{\kappa})/(P_{\theta f}V_{\theta f}^{\kappa}-P_{\theta 0}V_{\theta 0}^{\kappa}) \quad \text{(Equation 1)}$$

In Equation 1 above, $P_{\theta 0}$ and $V_{\theta 0}$ are an in-cylinder pressure Pc and in-cylinder volume V that prevail when the crank angle θ coincides with a predetermined combustion start time θ0, and $P_{\theta f}$ and $V_{\theta f}$ are an in-cylinder pressure Pc and in-cylinder volume V that prevail when the crank angle θ coincides with a predetermined combustion end time θf. $P_{\theta}$ and $V_{\theta}$ are an in-cylinder pressure Pc and in-cylinder volume V that prevail when the crank angle θ is an arbitrary value. κ denotes a specific heat ratio. According to Equation 1 above, the record of the combustion ratio MFB can be calculated in accordance with measured in-cylinder pressure values Pc and calculated in-cylinder volume values V prevailing at the above three points.

Meanwhile, the waveform designated "WeibeMFB" in FIG. 2 represents a combustion ratio MFB that is calculated by a formula based on the Weibe function, that is, the following equation (Equation 2):

$$MFB=1-\exp[-a\{(\theta-\theta 0)/(\theta f-\theta 0)\}^{m+1}] \quad \text{(Equation 2)}$$

In Equation 2 above, a is a combustion speed and m is a predefined constant.

As indicated in FIG. 2, the waveform of the combustion ratio $PV^{\kappa}$MFB calculated according to Equation 1 highly correlates with that of the combustion ratio WeibeMFB calculated according to Equation 2. Therefore, the present embodiment assumes that the above two equations are equivalent to each other, and derives the following equation (Equation 3) from the above two equations:

$$P_{\theta}=(1/V_{\theta}^{\kappa})\times\left\langle\{1-\exp[-a\{(\theta-\theta 0)/(\theta f-\theta 0)\}^{m+1}]\}\times(P_{\theta f}V_{\theta f}^{\kappa}-P_{\theta 0}V_{\theta 0}^{\kappa})+P_{\theta 0}V_{\theta 0}^{\kappa}\right\rangle \quad \text{(Equation 3)}$$

The system according to the present embodiment assumes that Equation 3 is used to estimate the in-cylinder pressure Pc of the internal combustion engine 10. A method for calculating the estimated in-cylinder pressure $P_{\theta}$ will now be described with reference to a routine that is shown in FIG. 3.

Figure 3:
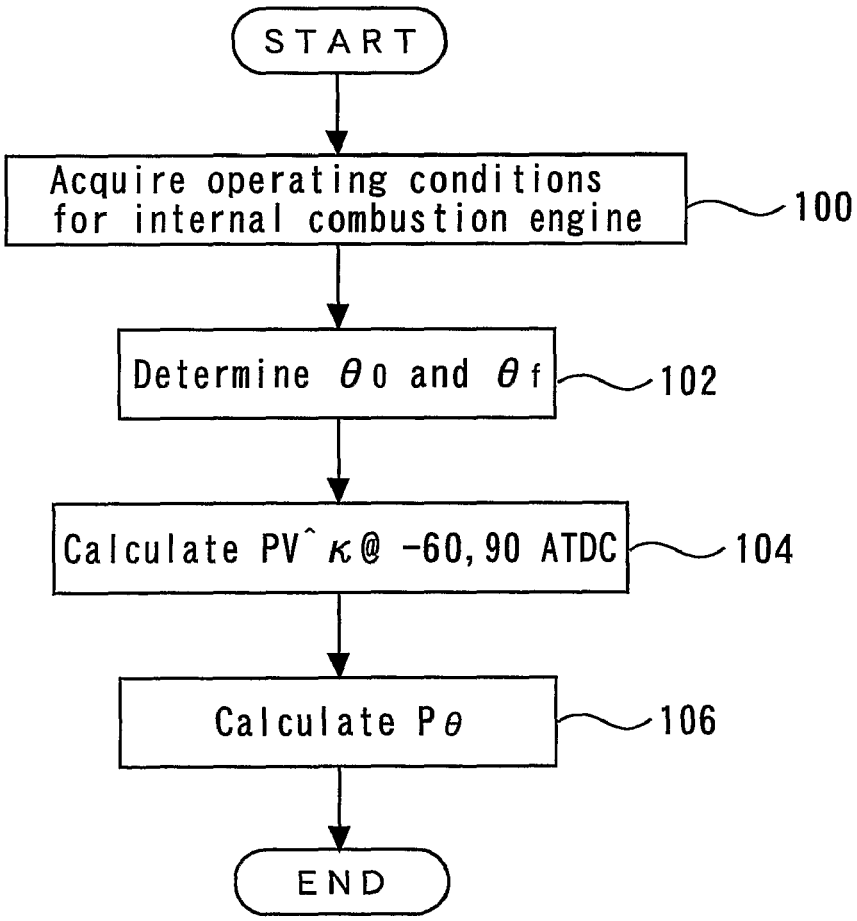
FIG. 3 is a flowchart illustrating a routine that is executed to acquire the estimated in-cylinder pressure $P_\theta$ in the first embodiment of the present invention.

FIG. 3 is a flowchart illustrating a routine that the ECU 40 executes to acquire the estimated in-cylinder pressure $P_{\theta}$. In the routine shown in FIG. 3, step 100 is performed first to acquire the operating conditions for the internal combustion engine 10, more specifically, the ignition timing SA and the like.

Figure 4:
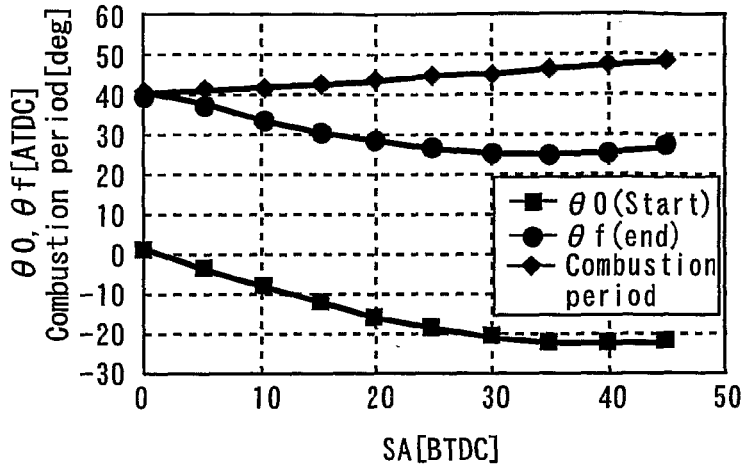
FIG. 4 is an example of a map of the combustion start time θ0 and combustion end time θf referred in the routine shown in FIG. 3.

Next, step 102 is performed to determine the combustion start time θ0 and combustion end time θf. The ECU 40 stores a map that defines the relationship among the combustion start time θ0, combustion end time θf, and ignition timing SA as shown in FIG. 4. The zero point in FIG. 4 represents a compression top dead center. The map shown in FIG. 4 is formulated so that when the ignition timing SA advances, the combustion start time θ0 shifts toward the advancing side relative to the compression top dead center, and that when the ignition timing SA is advanced from a predetermined ignition timing SA (30° BTDC in the employed example), the combustion start time θ0 is virtually fixed. For the combustion end time θf, the map is formulated in virtually the same manner.

After step 102 is performed to determine the combustion start time θ0 and combustion end time θf based on the current ignition timing SA in accordance with the map shown in FIG. 4, step 104 is performed to calculate the parameters (heat release amount) $PV^{\kappa}$ at −60° ATDC and 90° ATDC. More specifically, step 104 is performed to acquire the in-cylinder pressures P at −60° ATDC and 90° ATDC in accordance with the output from the in-cylinder pressure sensor 32, and calculate the in-cylinder volumes V corresponding to −60° ATDC and 90° ATDC. The parameters $PV^{\kappa}$ are calculated in accordance with the obtained values.

Next, step 106 is performed to calculate the in-cylinder pressure $P_\theta$ in accordance with Equation 3. More specifically, the combustion start time θ0 and combustion end time θf, which were determined in step 102, are substituted into Equation 3. Further, the parameter $PV^\kappa$ for −60° ATDC, which was calculated in step 104, is substituted as parameter $P_{\theta 0}V_{\theta 0}^\kappa$, and the parameter $PV^\kappa$ for 90° ATDC, which was calculated in step 104, is substituted as parameter $P_{\theta f}V_{\theta f}^\kappa$. As regards the combustion speed a and constant m, predetermined values are used. Consequently, when an associated arbitrary crank angle θ and an in-cylinder volume $V_\theta$ corresponding to the crank angle θ are substituted into Equation 3, the in-cylinder pressure $P_\theta$ prevailing at the arbitrary crank angle θ can be calculated. Further, when an associated crank angle θ and an in-cylinder volume $V_\theta$ corresponding the crank angle θ are substituted for each unit crank angle θ, a record of the estimated in-cylinder pressure $P_\theta$ can be calculated.

Figure 5:
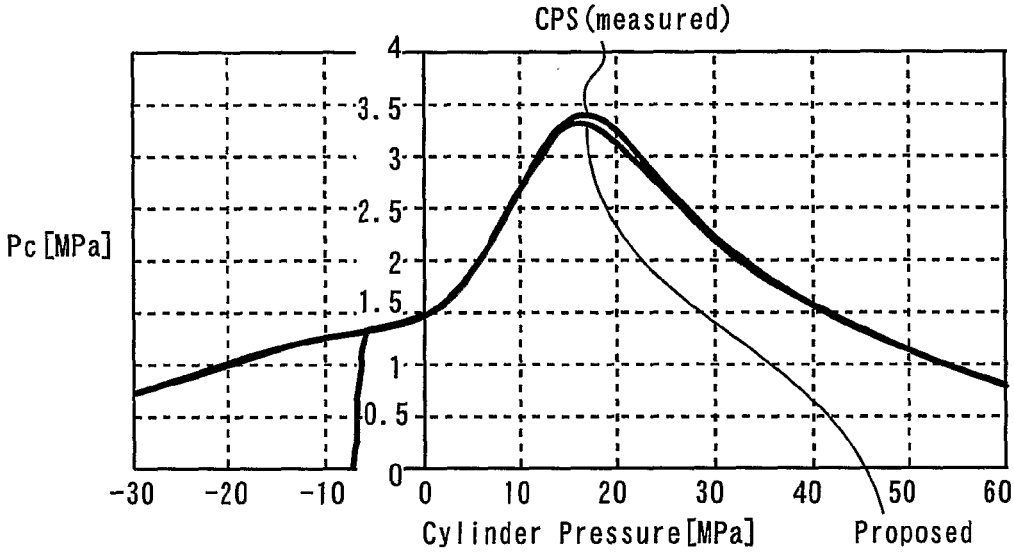
FIG. 5 is a P-θ diagram that shows the relationship between the in-cylinder pressure P and crank angle θ.

FIG. 5 is a P-θ diagram that shows the relationship between the in-cylinder pressure P and crank angle θ. The waveform designated "CPS" in FIG. 5 represents a measured in-cylinder pressure Pc, which is based on the output of the in-cylinder pressure sensor 32. Meanwhile, the waveform designated "Proposed" in FIG. 5 represents a record of the in-cylinder pressure $P_\theta$ that was estimated by routine shown in FIG. 3. FIG. 5 indicates that the use of the in-cylinder pressure estimation method according to the present embodiment makes it possible to obtain an estimated in-cylinder pressure $P_\theta$ that is substantially equal to the measured in-cylinder pressure Pc. As described above, the use of the method according to the present embodiment makes it possible to obtain the data on the in-cylinder pressure $P_\theta$ at an arbitrary crank angle θ simply by using only two measured data (two data measured at −60° ATDC and 90° ATDC in the routine shown in FIG. 4).

Figure 6:
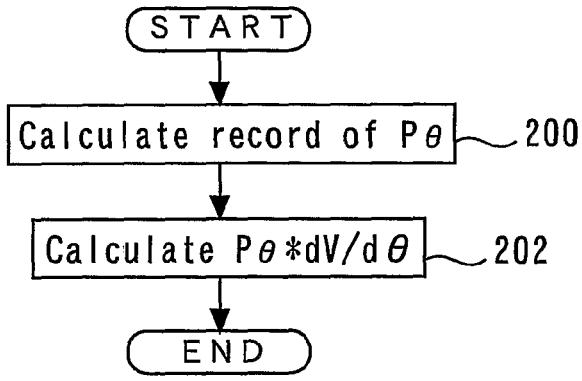
FIG. 6 is a flowchart illustrating a routine that is executed to calculate an indicated torque with the record of the estimated in-cylinder pressure $P_\theta$ in the first embodiment of the present invention.

Referring to FIG. 6, the record of the estimated in-cylinder pressure $P_\theta$, which was obtained by executing the routine shown in FIG. 4, will be used to describe the method of calculating the indicated torque prevailing in the cycle during which the record was acquired.

FIG. 6 is a flowchart illustrating a routine that the ECU 40 executes to calculate an indicated torque with the record of the estimated in-cylinder pressure $P_\theta$. In the routine shown in FIG. 6, the record of the estimated in-cylinder pressure $P_\theta$ is first calculated by performing step 106 of the routine shown in FIG. 3 for each unit crank angle θ (step 200).

Next, the indicated torque $P_\theta \times dV/d\theta$ is calculated by multiplying the record of the estimated in-cylinder pressure $P_\theta$, which was obtained in step 200, by dV/dθ, which is a rate of change in the in-cylinder volume V (step 202).

In the internal combustion engine having the in-cylinder pressure sensor, the performance of a present-day ECU is not high enough to convert an analog output of the in-cylinder pressure sensor to a digital signal at a high speed that permits accurate determination of the indicated torque. Meanwhile, the computation capability of a CPU in the ECU is adequate. When the routine shown in FIG. 6 is executed, the record of the in-cylinder pressure $P_\theta$ can be estimated simply by measuring the in-cylinder pressure $P_\theta$ at two points. Further, the indicated torque $P_\theta \times dV/d\theta$ can be calculated from the estimated record. Consequently, the indicated torque $P_\theta \times dV/d\theta$ can be determined accurately in real time without being restricted by the performance of the ECU 40.

In the first embodiment, which has been described above, the "heat release amount information acquisition means" according to the first or third aspect of the present invention is implemented when the ECU 40 performs step 104; and the "relationship information acquisition means" and "pressure estimation means" according to the first or third aspect of the present invention are implemented when step 106 is followed to perform a predetermined process by using Equation 3. Equation 3 corresponds to the "relationship information" according to the first or third aspect of the present invention.

Further, the "combustion ratio information acquisition means" according to the third aspect of the present invention is implemented when the ECU 40 performs step 106 to calculate a term related to the Weibe function in Equation 3.

The in-cylinder pressure sensor 32 corresponds to the "in-cylinder pressure detection means" according to the fifth aspect of the present invention.

SECOND EMBODIMENT

A second embodiment of the present invention will now be described with reference to FIGS. 7 and 8.

Figure 7:
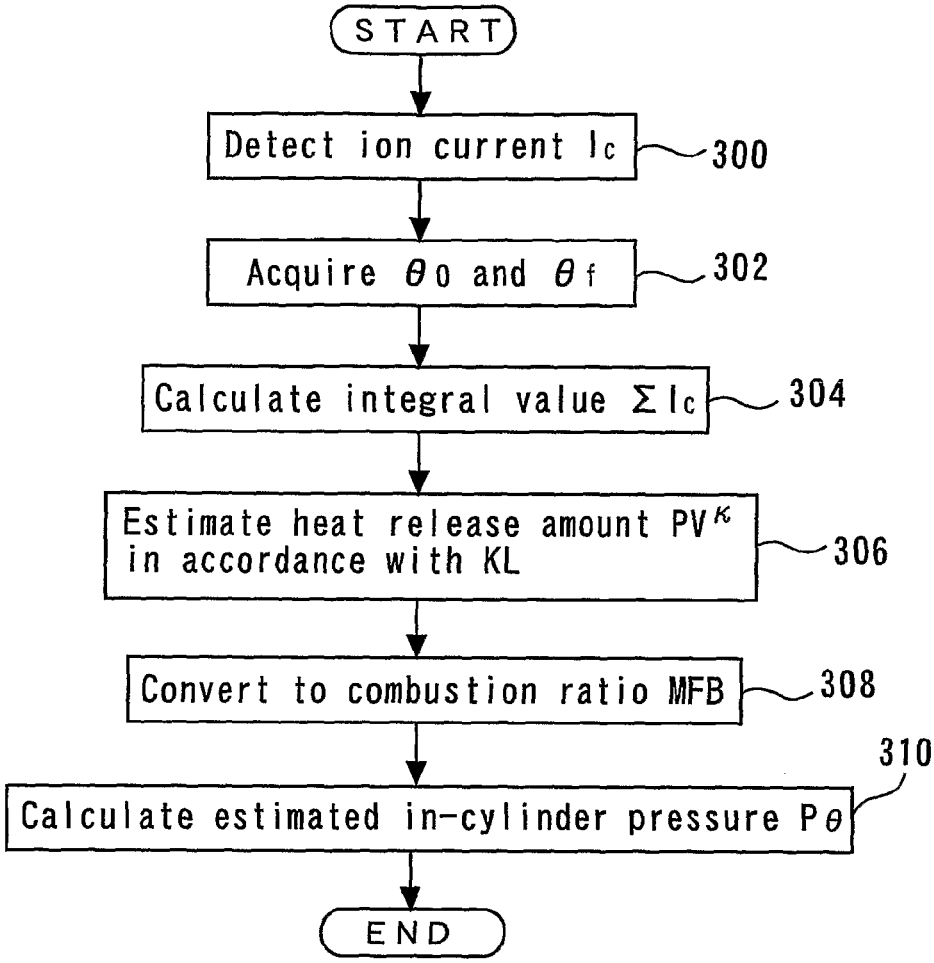
FIG. 7 is a flowchart illustrating a routine that is executed in the second embodiment of the present invention.
Figure 8:
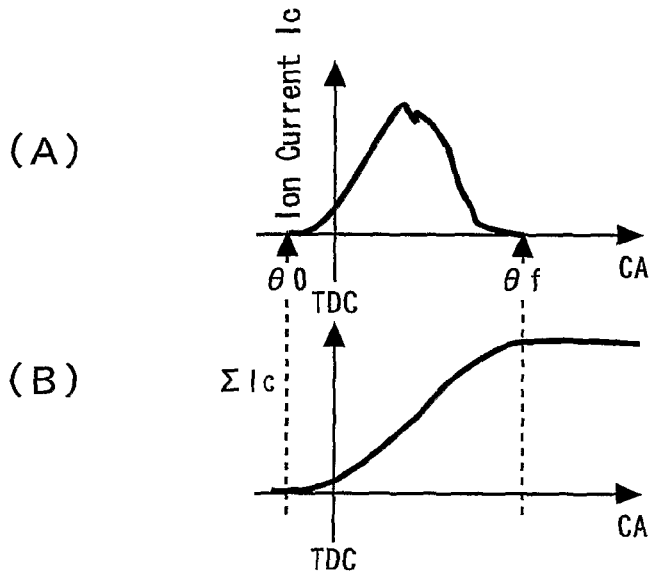
FIGS. 8A and 8B illustrate a waveform of the ion current Ic.

The system according to the second embodiment is implemented by adopting the hardware configuration shown in FIG. 1 and allowing the ECU 40 to execute a routine shown in FIG. 7 instead of the routine shown in FIG. 3. More specifically, the system according to the present embodiment differs from the system according to the first embodiment in that the latter uses the ignition plug 28 as an ion probe (ion current sensor) that detects ions generated in a cylinder during a combustion period as an ion current Ic. The system according to the present embodiment uses such an ion current Ic to acquire the record of the estimated in-cylinder pressure $P_\theta$.

FIG. 7 is a flowchart illustrating a routine that the ECU 40 executes to implement the above functionality in accordance with the second embodiment. In the routine shown in FIG. 7, step 300 is performed first to detect an ion current Ic for a predetermined period. More specifically, a predetermined voltage is applied to electrodes of the ignition plug 28 after completion of ignition by the ignition plug 28 for the purpose of detecting the ion current Ic. The ion current Ic is detected as a current that flows between the electrodes.

Next, step 302 is performed to acquire the combustion start time θ0 and combustion end time θf. FIG. 8A shows a waveform of the ion current Ic that was detected when the ignition plug 28 was used as an ion probe. The ion current Ic arises when combustion starts upon ignition, and vanishes when combustion ends later. Therefore, the combustion start time θ0 and combustion end time θf can be acquired in accordance with the waveform of a measured ion current as indicated in FIG. 8A.

Next, step 304 is performed to calculate the integral value ΣIc of the ion current Ic with respect to the period between the combustion start time θ0 and combustion end time θf, which were acquired in step 302. FIG. 8B shows a waveform of the integral value ΣIc of the ion current Ic. The ion current Ic highly correlates with the heat release rate dQ/dθ prevailing during a combustion period. The value ΣIc, which was obtained by integrating the ion current Ic with respect to the period between the combustion start time θ0 and combustion end time θf as indicated in FIG. 8B, highly correlates with the combustion ratio MFB (heat release amount).

Next, step 306 is performed to estimate a heat release amount $PV^\kappa$ in accordance with a load factor KL. The load factor KL and heat release amount $PV^\kappa$ of the internal combustion engine 10 have linear characteristics. Here, the heat release amount $PV^\kappa$ is estimated from the load factor KL in accordance with a map that defines the relationship between the load factor KL and heat release amount $PV^\kappa$. Alternatively, the heat release amount $PV^\kappa$ may be estimated in accordance with a map that defines the relationship between the heat release amount $PV^\kappa$ and an in-cylinder DJ value (the value indicating an in-cylinder filled air amount) based on intake pressure and intake temperature, instead of the load factor KL.

Next, step 308 is performed to convert the above integral value ΣIc to the combustion ratio MFB. More specifically, the integral value ΣIc is converted to a value corresponding to the combustion ratio MFB for the current combustion cycle when the integral value ΣIc is corrected in accordance, for instance, with an in-cylinder air amount. Next, step 310 is performed to calculate the estimated in-cylinder pressure $P_\theta$. More specifically, the combustion ratio MFB based on the ion current Ic, which was acquired in step 308, is substituted into the term of the Weibe function that corresponds to the combustion ratio MFB in Equation 3. The estimated in-cylinder pressure $P_\theta$ is calculated when a value based on the heat release amount $PV^\kappa$, which was acquired in step 306, is substituted into the remaining terms of Equation 3.

Even when a method involving the ion current Ic, which has been described in conjunction with the routine shown in FIG. 7, is used, the estimated in-cylinder pressure $P_\theta$ can be calculated from Equation 3. Further, when this method is employed, the ignition plug 28 can be used as an ion probe. Therefore, this method is more advantageous in terms of sensor mountability on the internal combustion engine 10 than the method of using the in-cylinder pressure sensor 32.

In the second embodiment, which has been described above, the "heat release amount information acquisition means" according to the first or third aspect of the present invention is implemented when the ECU 40 performs step 306; and the "combustion ratio information acquisition means" according to the first or third aspect of the present invention is implemented when the ECU 40 performs steps 300, 302, and 308.

The ignition plug 28 corresponds to the "ion detection means" according to the sixth aspect of the present invention.

THIRD EMBODIMENT

[Knock Judgment According to Estimated In-Cylinder Pressure $P_\theta$]

A third embodiment of the present invention will now be described with reference to FIGS. 9 to 12.

The system according to the third embodiment also uses the hardware configuration shown in FIG. 1. The third embodiment is characterized by the fact that the estimated value of the in-cylinder pressure $P_\theta$, which is acquired by the routine shown in FIG. 3, is used to check for knocking.

Figure 9:
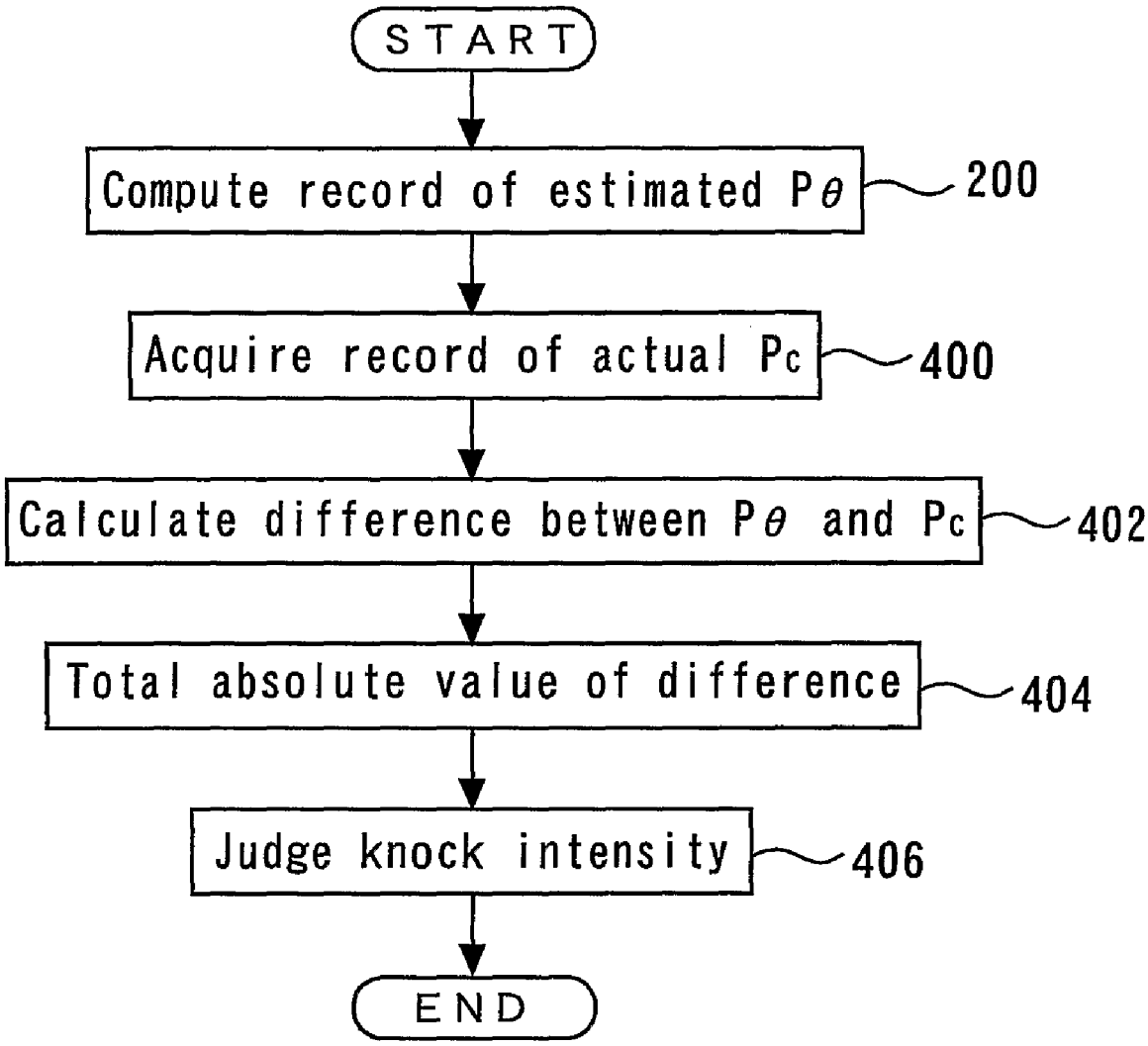
FIG. 9 is a flowchart illustrating a routine that is executed in the third embodiment of the present invention.
Figure 10:
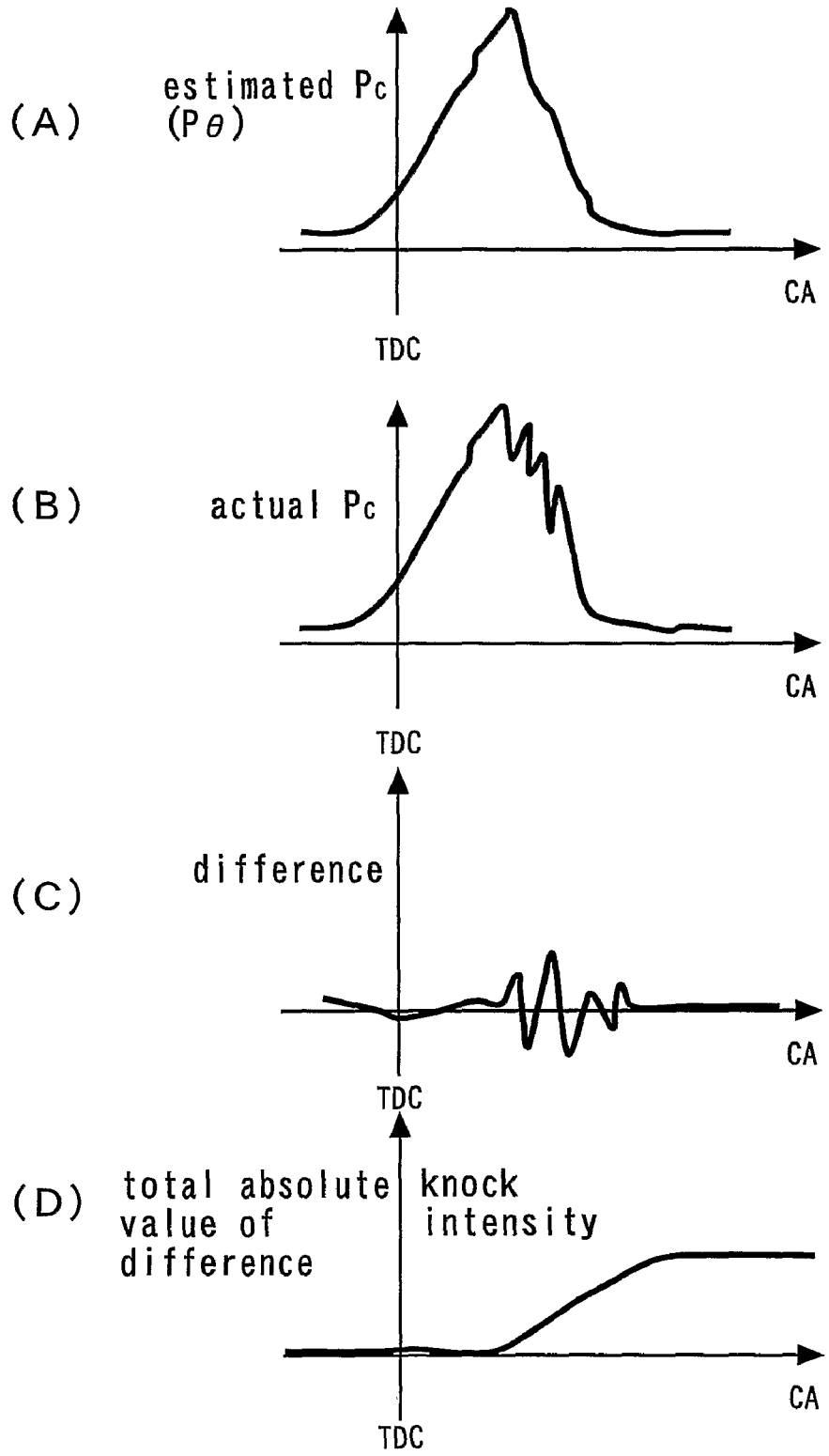
FIGS. 10A to 10D illustrate a procedure of knock judgment in the third embodiment of the present invention.

FIG. 9 is a flowchart illustrating a routine that the ECU 40 executes to implement the above functionality in accordance with the third embodiment. When the third embodiment is described with reference to FIG. 9, steps identical with those described with reference to FIG. 6 for the first embodiment are designated by the same reference numerals as their counterparts and omitted from the description or briefly described. In the routine shown in FIG. 9, step 200 is performed first to compute the record of the estimated in-cylinder pressure $P_\theta$. FIG. 10A shows a typical waveform of the in-cylinder pressure $P_\theta$ that is computed in step 200.

Next, step 400 is performed to acquire a record of actual in-cylinder pressure Pc in accordance with an output from the in-cylinder pressure sensor 32. FIG. 10B shows a typical waveform of the actual in-cylinder pressure Pc prevailing in the event of knocking and is acquired in step 400. As indicated in FIG. 10B, a high-frequency pressure component is superposed over the waveform of the actual in-cylinder pressure Pc prevailing in the event of knocking. On the other hand, the waveform of the estimated in-cylinder pressure $P_\theta$ shown in FIG. 10A is calculated through a first-order lag function (Equation 3). Therefore, this waveform is smooth with no high-frequency pressure component superposed over it.

In the routine shown in FIG. 9, step 402 is performed next to calculate the difference between the waveform of the estimated in-cylinder pressure $P_\theta$, which was computed in step 200, and the waveform of the actual in-cylinder pressure Pc, which was acquired in step 400. When step 402 is performed, only the knocking-induced high-frequency pressure component (the information about knocking) can be obtained from the waveform of the actual in-cylinder pressure Pc as indicated in FIG. 10C.

Next, step 404 is performed to total the absolute value of the difference calculated in step 402. FIG. 10D shows a waveform that is obtained when step 404 is performed. Next, step 406 is performed to judge the knock intensity. More specifically, when a predetermined threshold value is exceeded by the obtained total difference, it is concluded that knocking has occurred. Here, it is assumed that the absolute value of the difference is totaled. However, a peak value of the difference may be used instead of the total value to judge the knock intensity.

When the routine shown in FIG. 9 is executed as described above, a knock judgment can be formulated by using the record of estimated in-cylinder pressure $P_\theta$ according to the present invention. The use of this method makes it possible to compare the estimated in-cylinder pressure $P_\theta$ and actual in-cylinder pressure Pc prevailing in the same combustion cycle. Therefore, knock detection can be achieved with higher accuracy than during the use of the conventional method of estimating a normal in-cylinder pressure for the current combustion cycle from a phenomenon encountered during the preceding combustion cycle or from statistics. Further, the use of the above method also makes it possible to formulate a knock judgment without having to furnish the ECU 40 with an internal high-pass filter circuit for extracting the high-frequency pressure component in the event of knocking. This makes it possible to eliminate the cost of the high-pass filter circuit and reduce the cost required for noise control.

Figure 11:
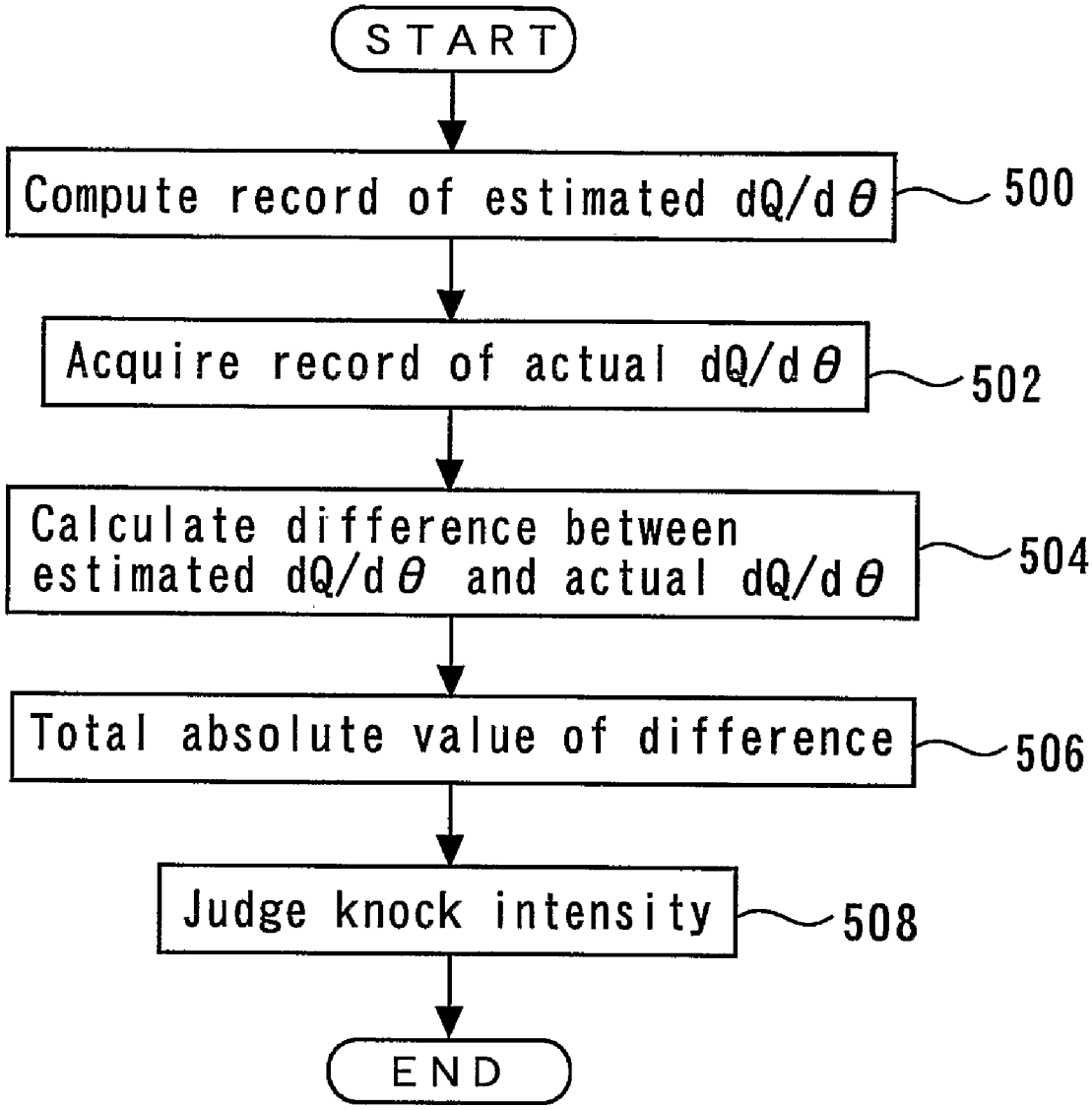
FIG. 11 is a flowchart illustrating a routine that is executed in a modified embodiment of the third embodiment of the present invention.
Figure 12:
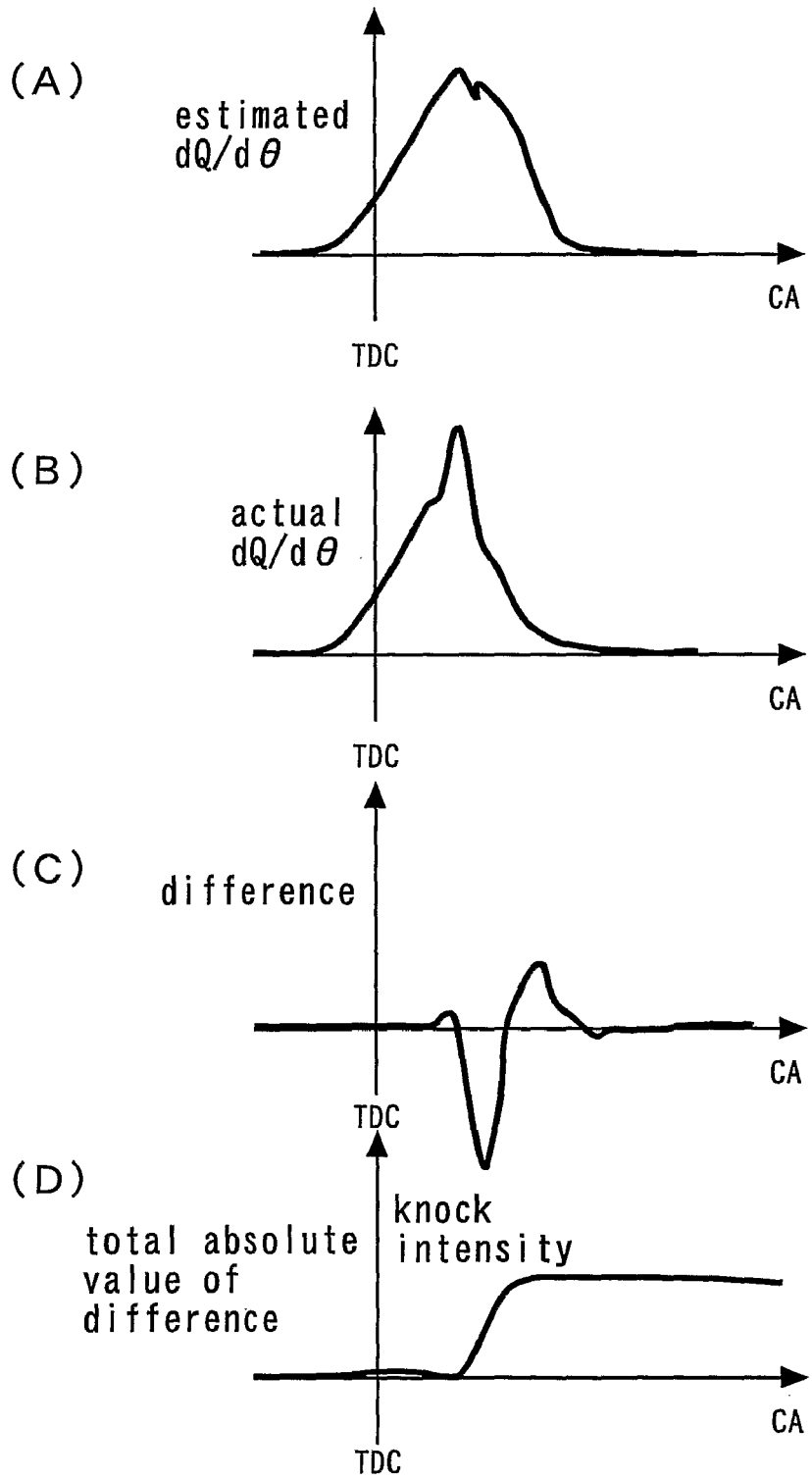
FIGS. 12A to 12D illustrate a procedure of knock judgment in the modified embodiment of the third embodiment of the present invention.

The third embodiment, which has been described above, formulates a knock judgment by directly comparing the estimated value and actual value of the in-cylinder pressure Pc. However, the present invention is not limited to the use of such a knock judgment method. For example, a method described with reference to FIGS. 11 and 12 may alternatively be used. FIG. 11 is a flowchart illustrating a routine that the ECU 40 executes to compare the estimated value and actual value of the heat release rate dQ/dθ and formulate a knock judgment. In the routine shown in FIG. 11, step 500 is performed first to calculate a record of the estimated heat release rate dQ/dθ. More specifically, processing is performed in the same manner as in step 200 to compute the record of the estimated in-cylinder pressure $P_\theta$ and calculate the record of the estimated heat release rate dQ/dθ from the computed record of the estimated in-cylinder pressure Pc by using a predetermined calculation formula. FIG. 12A shows a typical waveform of the estimated heat release rate dQ/dθ that is calculated in step 500.

Next, step 502 is performed in accordance with a predetermined calculation formula to calculate the record of the actual heat release rate dQ/dθ from the record of the actual in-cylinder pressure Pc that is acquired in accordance with the output from the in-cylinder pressure sensor 32. FIG. 12B shows a typical waveform of the actual heat release rate dQ/dθ that is calculated in step 502 when knocking actually occurs. If knocking occurs, fast burning takes place. Therefore, the waveform of the actual release rate dQ/dθ, which is shown in FIG. 12B, indicates that the combustion peak value is great and that combustion ends early. On the other hand, knocking is not reflected in the waveform of the estimated heat release rate dQ/dθ, which is shown in FIG. 12A.

In the routine shown in FIG. 11, step 504 is then performed to calculate the difference between the waveform of the estimated heat release rate dQ/dθ, which was calculated in step 500, and the waveform of the actual heat release rate dQ/dθ, which was acquired in step 502. The process performed in step 504 makes it possible to extract only the information about knocking (the information indicating the characteristics of knocking) from the waveform of the actual heat release rate dQ/dθ as shown in FIG. 12C.

Next, step 506 is performed to total the absolute value of the difference calculated in step 504. FIG. 12D shows a waveform that is obtained when step 506 is performed. Next, step 508 is performed to judge the knock intensity. The judgment method used in step 508 will not be described in detail because it is the same as in the use of the in-cylinder pressure Pc. The use of the method of using the heat release rate dQ/dθ, which has been described above, also makes it possible to check for knocking. When the estimated in-cylinder pressure $P_\theta$ is to be determined for the actual use of this method, the in-cylinder state may be detected with the in-cylinder pressure sensor 32 in a manner described in conjunction with the routine shown in FIG. 3. An alternative is to detect the in-cylinder state in a manner described in conjunction with the routine shown in FIG. 7 while using the ignition plug 28 as an ion probe. However, the method of using the ion probe is more appropriate because it does not generate any high-frequency component.

The third embodiment, which has been described above, checks for knocking by comparing the total value acquired in step 404 against a predetermined threshold value. However, the present invention is not limited to the use of such a knock judgment method. Alternatively, the encountered knocking level may be judged in accordance with the magnitude of the total value. For a region where the load factor KL is high so that knocking is likely to occur, the routine shown in FIG. 9 may be executed to formulate a knock judgment.

In the third embodiment and its modified embodiments, which have been described above, the "knock information acquisition means" according to the eleventh aspect of the present invention is implemented when the ECU 40 performs steps 402 to 406; the "estimated heat release rate acquisition means" according to the twelfth aspect of the present invention is implemented when the ECU 40 performs step 500; the "actual heat release rate acquisition means" according to the twelfth aspect of the present invention is implemented when the ECU 40 performs step 502; and the "knock information acquisition means" according to the twelfth aspect of the present invention is implemented when the ECU 40 performs steps 504 to 508.

FOURTH EMBODIMENT

[MBT Control with Estimated In-Cylinder Pressure $P_\theta$]

A fourth embodiment of the present invention will now be described with reference to FIG. 13.

The system according to the fourth embodiment also uses the hardware configuration shown in FIG. 1. The fourth embodiment is characterized by the fact that MBT (optimum ignition timing) control is exercised by using the estimated in-cylinder pressure Pθ obtained by the routine shown in FIG. 3.

Figure 13:
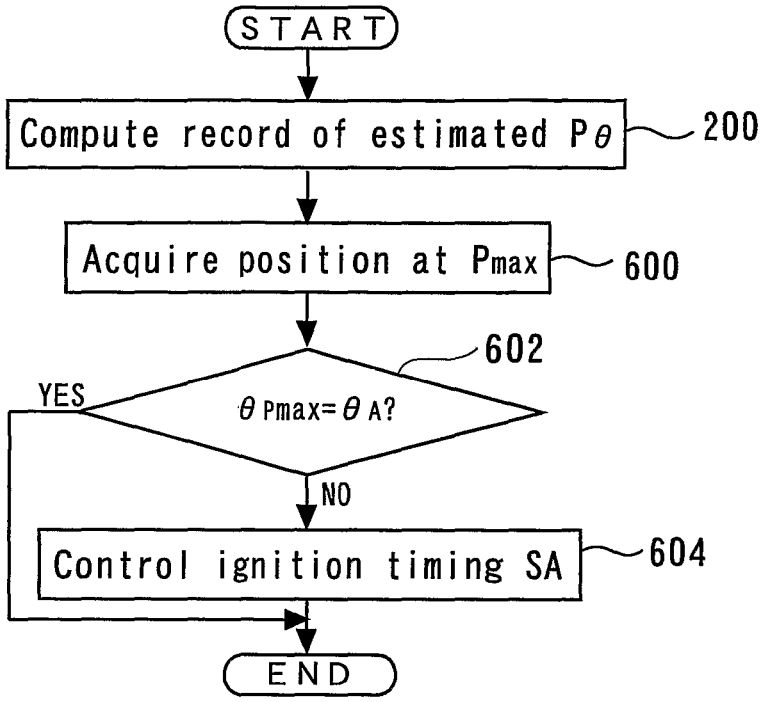
FIG. 13 is a flowchart illustrating a routine that is executed in the fourth embodiment of the present invention.

FIG. 13 is a flowchart illustrating a routine that the ECU 40 executes to implement the above functionality in accordance with the fourth embodiment. When the fourth embodiment is described with reference to FIG. 13, steps identical with those described with reference to FIG. 6 for the first embodiment are designated by the same reference numerals as their counterparts and omitted from the description or briefly described. In the routine shown in FIG. 13, step 200 is performed first to compute the record of the estimated in-cylinder pressure $P_\theta$.

Next, step 600 is performed to acquire a position (timing (crank angle $\theta_{Pmax}$)) at which the maximum value Pmax of the in-cylinder pressure Pc arises from the record of the estimated in-cylinder pressure $P_\theta$ calculated in step 200. Step 602 is then performed to judge whether the Pmax position $\theta_{Pmax}$, which was acquired in step 600, coincides with a predetermined position $\theta_A$. The ECU 40 stores the predetermined position $\theta_A$. When the position $\theta_{Pmax}$ of the maximum pressure value Pmax coincides with the predetermined position $\theta_A$, the ECU 40 concludes that the ignition timing SA is the MBT.

If the judgment result obtained in step 602 indicates that the position $\theta_{Pmax}$ of the maximum pressure value Pmax coincides with the predetermined position $\theta_A$, it can be concluded that the currently controlled ignition timing SA is the MBT. In this instance, therefore, the current processing cycle terminates without further controlling the ignition timing SA. If, on the other hand, the judgment result obtained in step 602 indicates that the position $\theta_{Pmax}$ of the maximum pressure value Pmax does not coincide with the predetermined position $\theta_A$, step 604 is performed to control the ignition timing SA. More specifically, if it is found that the position $\theta_{Pmax}$ of the calculated maximum pressure value Pmax is advanced from the predetermined position $\theta_A$, the ignition timing SA is retarded by a predefined amount according to the positional deviation so that the ignition timing SA is the MBT. If, on the other hand, it is found that the position $\theta_{Pmax}$ is retarded from the predetermined position $\theta_A$, the ignition timing SA is advanced by a predefined amount.

When the method of measuring the in-cylinder pressure Pc with the in-cylinder pressure sensor and holding its peak value (maximum value Pmax) is used, the position (timing) of the maximum value Pmax cannot be detected. When the method of causing the ECU to acquire measured an in-cylinder pressure Pc in real time is used to detect the above peak timing, it is necessary that the ECU perform high-speed sampling. In reality, however, the present-day ECU performance is not high enough to perform such high-speed sampling. Meanwhile, when the routine shown in FIG. 13 uses the information (record) concerning the aforementioned estimated in-cylinder pressure $P_\theta$ according to the present invention, and exercises control so that the position $\theta_{Pmax}$ at which the maximum value Pmax of the in-cylinder pressure Pc arises coincides with the predetermined position $\theta_A$, the ignition timing SA can be adjusted for the MBT.

In the fourth embodiment, which has been described above, the "pressure record acquisition means" according to the fourteenth aspect of the present invention is implemented when the ECU 40 performs step 200; the "maximum pressure value generation time acquisition means" according to the fourteenth aspect of the present invention is implemented when the ECU 40 performs step 600; and the "ignition timing control means" according to the fourteenth aspect of the present invention is implemented when the ECU 40 performs steps 602 and 604.

FIFTH EMBODIMENT

[Lean Limit Control with Estimated In-Cylinder Pressure $P_\theta$]

A fifth embodiment of the present invention will now be described with reference to FIG. 14.

The system according to the fifth embodiment also uses the hardware configuration shown in FIG. 1. The fifth embodiment is characterized by the fact that lean limit control is exercised to adjust the air-fuel ratio for a limit air-fuel ratio that provides a lean burn by using the estimated in-cylinder pressure $P_\theta$ obtained by the routine shown in FIG. 3.

Figure 14:
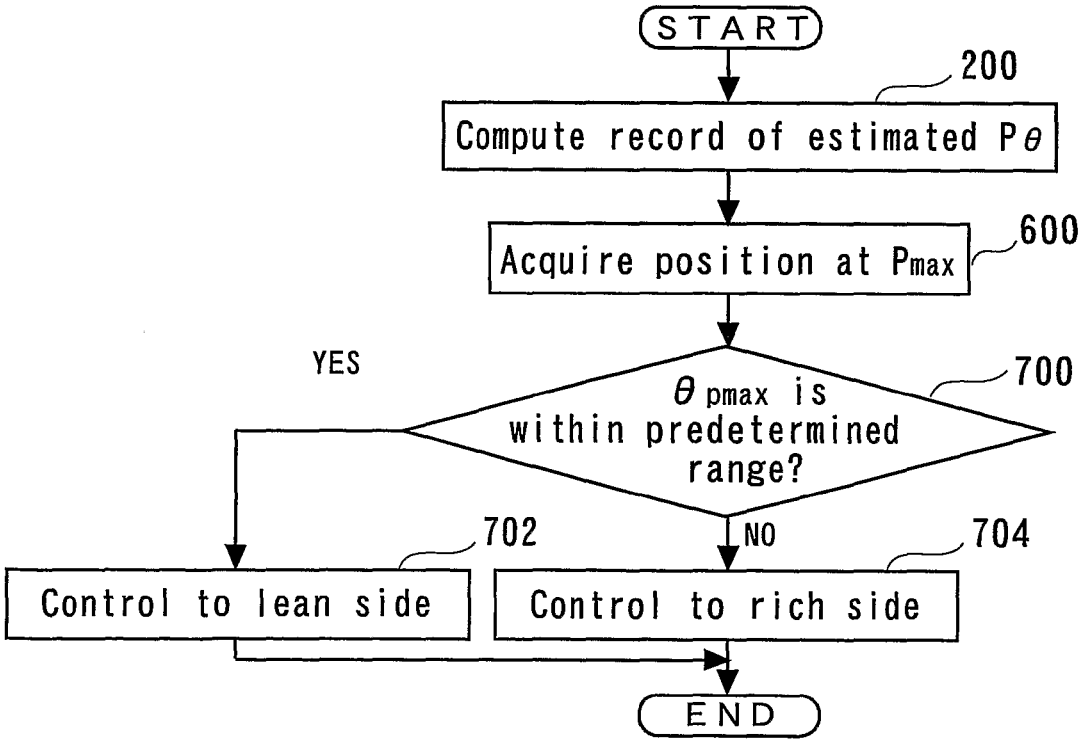
FIG. 14 is a flowchart illustrating a routine that is executed in the fifth embodiment of the present invention.

FIG. 14 is a flowchart illustrating a routine that the ECU 40 executes to implement the above functionality in accordance with the fifth embodiment. When the fifth embodiment is described with reference to FIG. 14, steps identical with those described with reference to FIG. 6 for the first embodiment are designated by the same reference numerals as their counterparts and omitted from the description or briefly described. In the routine shown in FIG. 14, step 200 is performed first to compute the record of the estimated in-cylinder pressure $P_\theta$. Next, step 600 is performed to acquire a position (timing (crank angle $\theta_{Pmax}$)) at which the maximum pressure value Pmax arises from the record of the estimated in-cylinder pressure $P_\theta$ computed in step 200.

Next, step 700 is performed to judge whether the position $\theta_{Pmax}$ of the maximum pressure value Pmax, which was acquired in step 600, is within a predetermined range of the crank angle θ. When combustion deterioration or misfire occurs in the internal combustion engine 10 due to an air-fuel ratio change toward a lean side, the maximum pressure value Pmax decreases and the timing (crank angle $\theta_{Pmax}$) with which the maximum pressure value Pmax arises deviates from the timing prevailing during normal combustion. The ECU 40 stores information that indicates the above-mentioned predetermined range of the crank angle θ for the purpose of grasping such a deviation in the timing $\theta_{Pmax}$, which is caused by a control operation for making the air-fuel ratio leaner.

If the judgment result obtained in step 700 indicates that the position $\theta_{Pmax}$ of the maximum pressure value Pmax is within the predetermined range, it can be concluded that the lean limit (the lean-side limit air-fuel ratio at which normal combustion is achievable) is not reached yet. In this instance, step 702 is performed to control the fuel injection amount so as to provide a leaner air-fuel ratio. If, on the other hand, the judgment result obtained in step 700 does not indicate that the position $\theta_{Pmax}$ of the maximum pressure value Pmax is within the predetermined range, it can be concluded that the lean limit is exceeded to cause combustion deterioration or other similar problem. In this instance, step 704 is performed to control the fuel injection amount so as to provide a richer air-fuel ratio.

Even when the performance of the vehicle-mounted ECU is limited as described earlier, the routine shown in FIG. 14, which has been described above, can exercise control to provide the leanest air-fuel ratio while maintaining the position $\theta_{Pmax}$ of the maximum pressure value Pmax within the predetermined range because it uses the information (record) concerning the aforementioned estimated in-cylinder pressure $P_\theta$ according to the present invention.

The fifth embodiment, which has been described above, controls the air-fuel ratio in accordance with the position $\theta_{Pmax}$ of the maximum pressure value Pmax. However, the maximum pressure value information according to the present invention is not limited to the position $\theta_{Pmax}$ of the maximum pressure value Pmax. For example, the air-fuel ratio may be controlled while considering the magnitude of the Pmax value as well as the position $\theta_{Pmax}$ of the maximum pressure value Pmax.

In the fifth embodiment, which has been described above, the "maximum pressure value information acquisition means" according to the fifteenth aspect of the present invention is implemented when the ECU 40 performs step 600; and the "air-fuel ratio control means" according to the fifteenth aspect of the present invention is implemented when the ECU 40 performs steps 700 to 704.

SIXTH EMBODIMENT

[Sensor Output Deviation Correction and Sensor Deterioration Detection with Estimated In-Cylinder Pressure $P_\theta$]

A sixth embodiment of the present invention will now be described with reference to FIG. 15.

The system according to the sixth embodiment also uses the hardware configuration shown in FIG. 1. The sixth embodiment is characterized by the fact that the estimated in-cylinder pressure $P_\theta$ obtained by the routine shown in FIG. 3 is used to correct an output deviation of the in-cylinder pressure sensor 32 and detect the deterioration of the same sensor 32.

Figure 15:
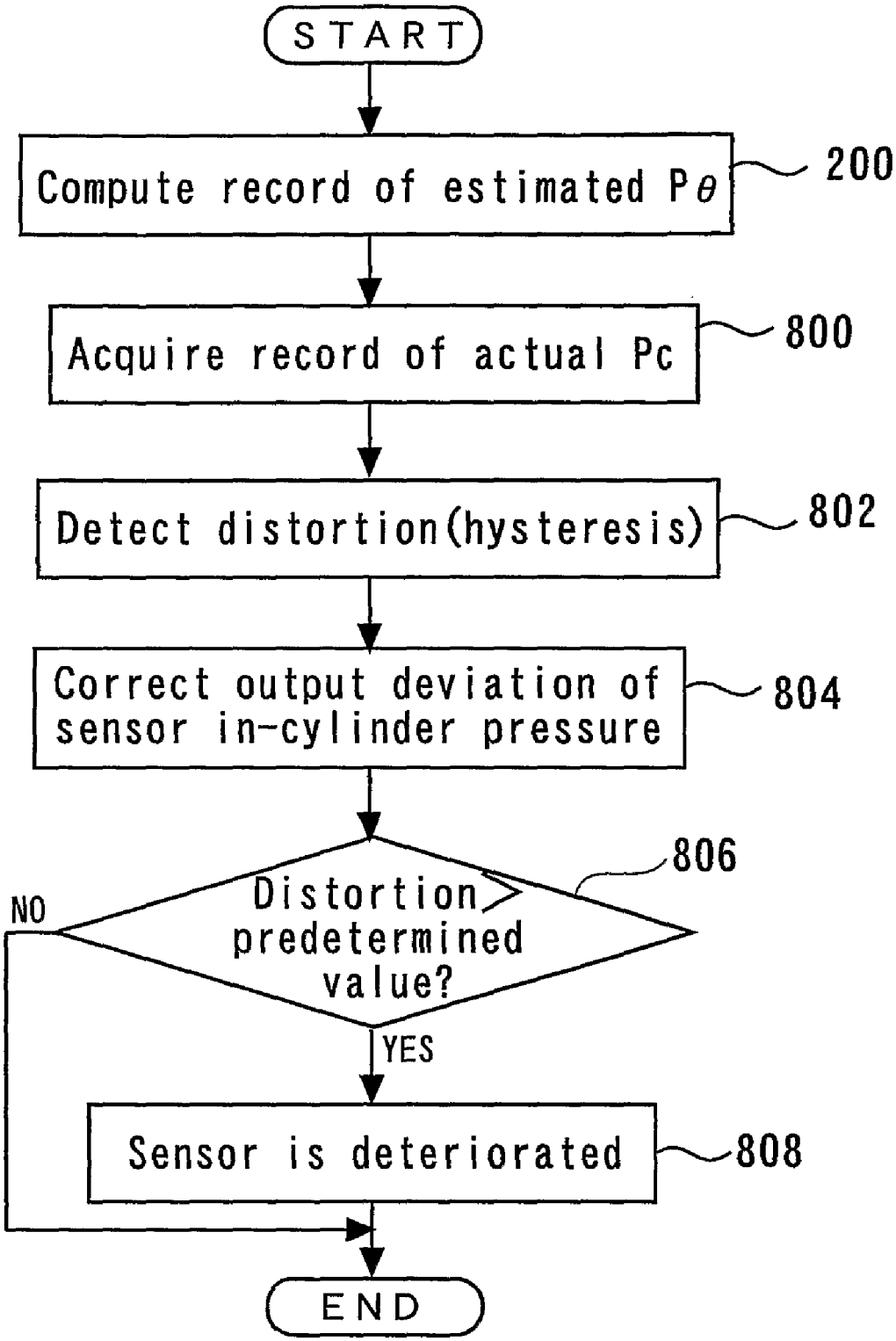
FIG. 15 is a flowchart illustrating a routine that is executed in the sixth embodiment of the present invention.

FIG. 15 is a flowchart illustrating a routine that the ECU 40 executes to implement the above functionality in accordance with the sixth embodiment. When the sixth embodiment is described with reference to FIG. 15, steps identical with those described with reference to FIG. 6 for the first embodiment are designated by the same reference numerals as their counterparts and omitted from the description or briefly described. In the routine shown in FIG. 15, step 200 is performed first to compute the record of the estimated in-cylinder pressure $P_\theta$. Next, step 800 is performed to acquire the record of the actual in-cylinder pressure Pc in accordance with an output from the in-cylinder pressure sensor 32.

Next, step 802 is performed to detect distortion (hysteresis) in the pressure record, which arises from a deviation in the output from the in-cylinder pressure sensor 32, by comparing the record of the estimated in-cylinder pressure $P_\theta$, which was computed in step 200, and the record of the actual in-cylinder pressure Pc, which was acquired in step 800. The above-mentioned distortion will not be superposed over the record of the estimated in-cylinder pressure $P_\theta$ that is calculated by the aforementioned method according to the present invention. Therefore, the distortion in the pressure record, that is, the output deviation of the in-cylinder pressure sensor 32, can be detected by comparing the estimated value and measured value of the in-cylinder pressure Pc as described above.

Next, step 804 is performed to correct the output deviation of the in-cylinder pressure sensor 32 in accordance with the distortion detected in step 802. Step 806 is then performed to judge whether the distortion detected in step 802 is greater than a predetermined value. If the obtained judgment result indicates that the distortion is greater than the predetermined value, step 808 is performed to conclude that the in-cylinder pressure sensor 32 is deteriorated. When a deterioration judgment is formulated in step 806, the distortion is compared against the predetermined value. However, the present invention is not limited to the use of such a deterioration judgment method. An alternative is to judge whether the distortion correction value used in step 804 is greater than a predetermined value.

According to the routine shown in FIG. 15, which has been described above, the estimated in-cylinder pressure $P_\theta$ and actual in-cylinder pressure Pc prevailing during the same combustion cycle can be compared. Therefore, sensor error detection can be achieved with higher accuracy than during the use of the conventional method of estimating a normal in-cylinder pressure for the current combustion cycle from a phenomenon encountered during the preceding combustion cycle or from statistics.

In the sixth embodiment, which has been described above, the record of the in-cylinder pressure $P_\theta$ that was estimated with the in-cylinder pressure sensor 32 is used for comparison with the actual in-cylinder pressure Pc. The method of correcting the output deviation of the in-cylinder pressure sensor 32 and detecting the deterioration of the same sensor 32 by using the estimated in-cylinder pressure $P_\theta$ according to the present invention is not limited to the use of the above comparison method. For example, sensor output deviation correction and sensor deterioration detection may be performed by comparing the in-cylinder pressure $P_\theta$, which the routine shown in FIG. 7 estimates with the ion probe, against the in-cylinder pressure measured by the in-cylinder pressure sensor 32. When this method is used, deterioration detection can be achieved for both the ion probe and in-cylinder pressure sensor 32.

In the sixth embodiment, which has been described above, the "distortion detection means" according to the sixteenth aspect of the present invention is implemented when the ECU 40 performs step 802; the "sensor output correction means" according to the sixteenth aspect of the present invention is implemented when the ECU 40 performs step 804; and the "sensor deterioration judgment means" according to the sixteenth aspect of the present invention is implemented when the ECU 40 performs steps 806 and 808.

SEVENTH EMBODIMENT

[Changing the Sampling Frequency for Actual In-Cylinder Pressure Pc in Accordance with Engine Speed NE]

A seventh embodiment of the present invention will now be described with reference to FIG. 16.

The system according to the seventh embodiment also uses the hardware configuration shown in FIG. 1. When the engine speed NE increases, the angular velocity of the crank angle θ increases. This reduces the intervals (time) of predetermined crank angles θ. Therefore, when the engine speed NE increases, it becomes more difficult for the ECU 40 to measure (sample) the actual in-cylinder pressure Pc in accordance with the output from the in-cylinder pressure sensor 32. Under such circumstances, the present embodiment changes the sampling frequency for the actual in-cylinder pressure Pc in accordance with the engine speed NE.

Figure 16:
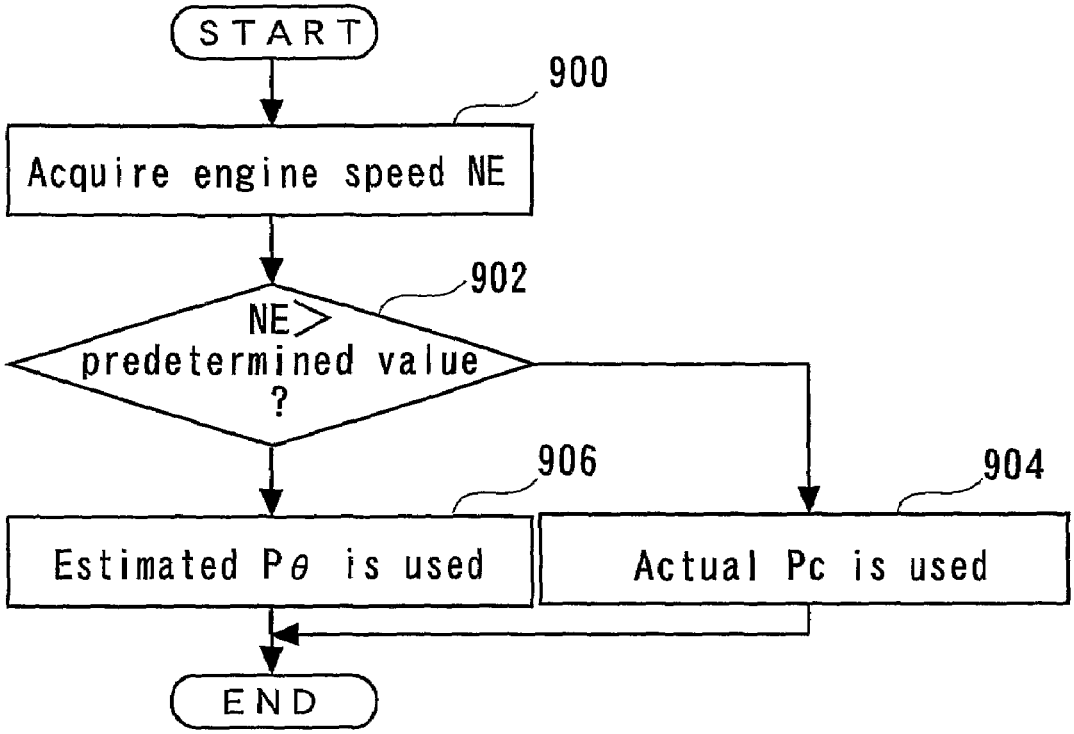
FIG. 16 is a flowchart illustrating a routine that is executed in the seventh embodiment of the present invention.

FIG. 16 is a flowchart illustrating a routine that the ECU 40 executes to implement the above functionality in accordance with the seventh embodiment. In the routine shown in FIG. 16, step 900 is performed first to acquire the engine speed NE. Next, step 902 is performed to judge whether the current engine speed NE is greater than a predetermined value.

If the judgment result obtained in step 902 indicates that the engine speed NE is not greater than the predetermined value, step 904 is performed to use the in-cylinder pressure Pc measured by the in-cylinder pressure sensor 32 as a basis for various engine control functions. If, on the other hand, the obtained judgment result indicates that the engine speed NE is greater than the predetermined value, step 906 is performed to use the estimated in-cylinder pressure $P_\theta$ calculated by Equation 3 as a basis for various engine control functions. More specifically, the record of the estimated in-cylinder pressure $P_\theta$ is computed, for instance, by performing step 106 of the routine shown in FIG. 3 for each unit crank angle θ.

As described earlier, when the method of estimating the in-cylinder pressure Pc by using Equation 3 is used, the in-cylinder pressure Pc at an arbitrary crank angle θ can be estimated with ease and high accuracy by using only two measured data. Therefore, the routine shown in FIG. 16 makes it possible to reduce the load on the ECU 40 by decreasing the sampling frequency of the ECU 40 within a region where the engine speed NE is high. Further, when, for instance, the above-mentioned routine is executed in a parallel manner in the knock judgment system that uses the estimated in-cylinder pressure $P_\theta$ in accordance with the third embodiment, the load imposed on the ECU 40 during a knock judgment sequence can be reduced in a region where the engine speed NE is high.

In the seventh embodiment, which has been described above, the "control basic data selection means" according to the eighteenth aspect of the present invention is implemented when the ECU 40 performs steps 902 and 906.

EIGHTH EMBODIMENT

[First Example of Torque Demand Control Based on Estimated In-Cylinder Pressure $P_\theta$]

An eighth embodiment of the present invention will now be described with reference to FIGS. 17 and 18.

The system according to the eighth embodiment also uses the hardware configuration shown in FIG. 1. The eighth embodiment uses the estimated in-cylinder pressure $P_\theta$ calculated by Equation 3, and exercises control so that the actual indicated torque of the internal combustion engine 10 coincides with a required torque based on the vehicle running state.

Figure 17:
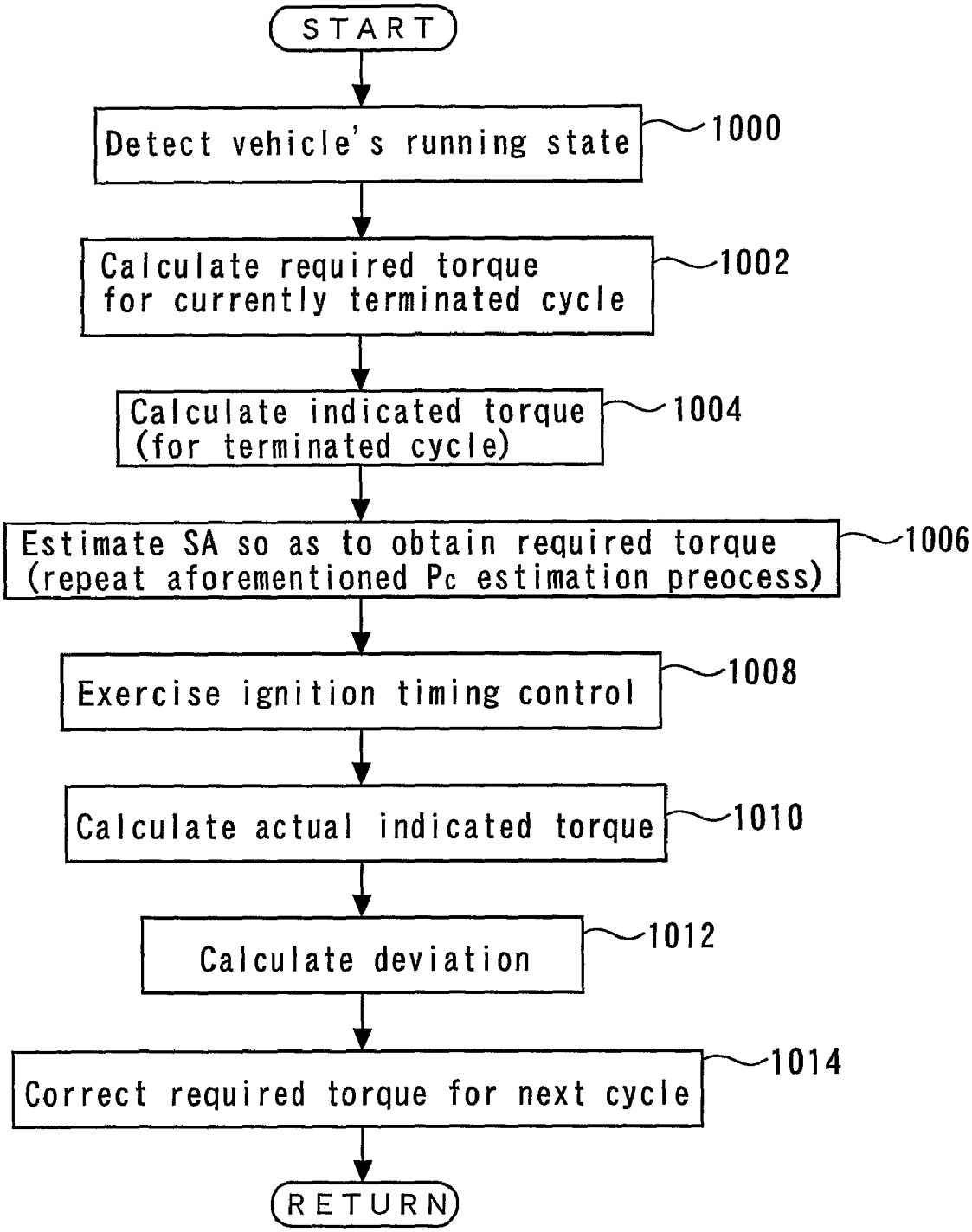
FIG. 17 is a flowchart illustrating a routine that is executed in the eighth embodiment of the present invention.

FIG. 17 is a flowchart illustrating a routine that the ECU 40 executes to implement the above functionality in accordance with the eighth embodiment. It is assumed that the routine is executed for each combustion cycle of the internal combustion engine 10 with predefined timing before the start of combustion. In the routine shown in FIG. 17, step 1000 is performed first to detect the vehicle's current running state by making use of various sensor outputs. More specifically, this step is followed to acquire the information about an accelerator pedal depression amount, the rate of a change in the accelerator pedal depression amount, the engine speed NE, the vehicle speed, and the like. Next, step 1002 is performed to calculate the required torque, which the internal combustion engine 10 should generate to comply with a driver's request, in accordance with the vehicle running state.

Next, step 1004 is performed to calculate the indicated torque for the previous combustion cycle. More specifically, the indicated torque for the previous cycle is calculated in the same manner as for the routine shown in FIG. 6. Next, step 1006 is performed to estimate the ignition timing SA in such a manner that the above-mentioned indicated torque coincides with the aforementioned required torque.

Figure 18:
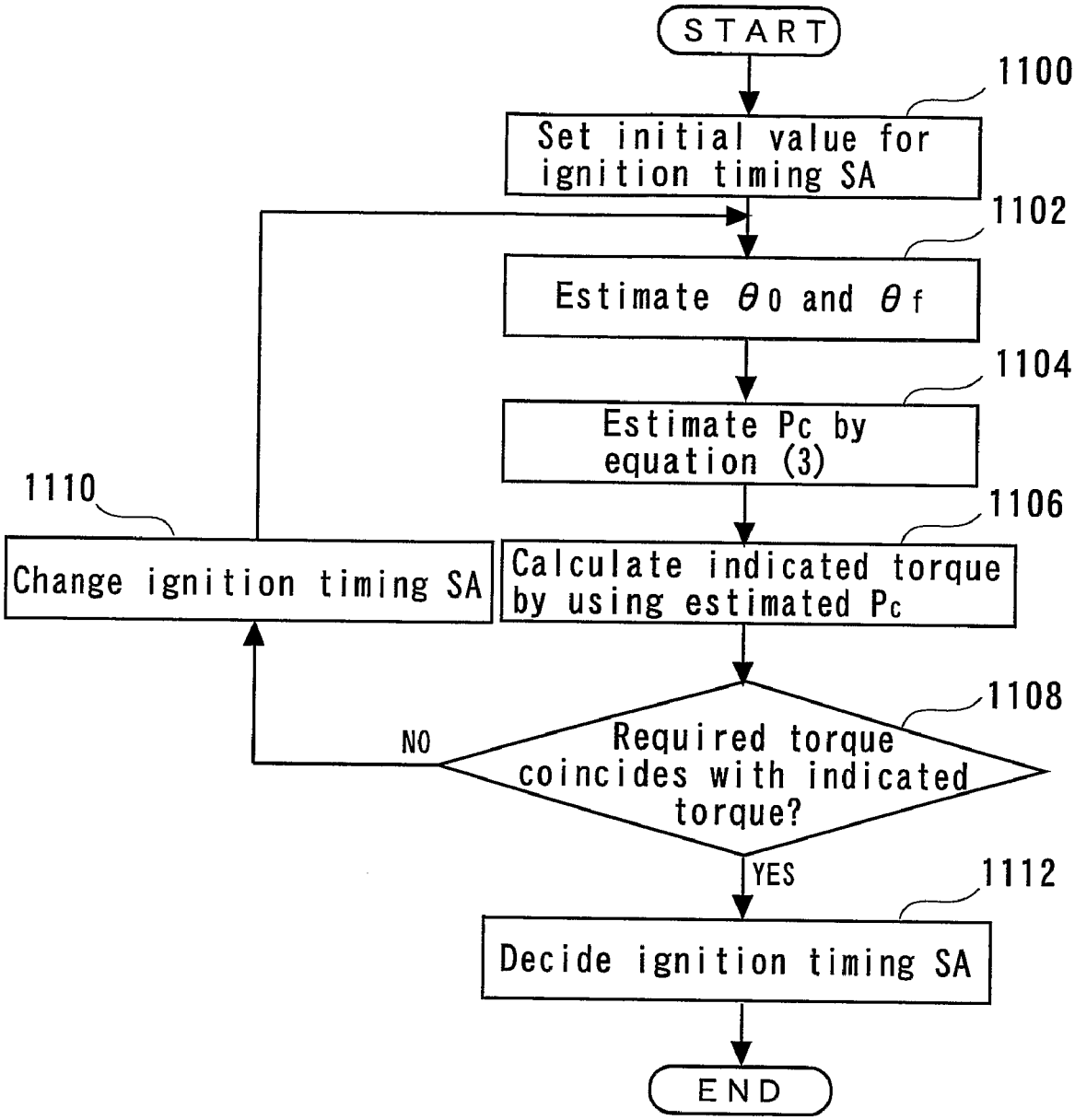
FIG. 18 is a flowchart illustrating a subroutine that is executed simultaneously with the routine shown in FIG. 17.

More specifically, step 1006 is performed to execute a routine that is shown in FIG. 18. In the routine shown in FIG. 18, step 1100 is performed first to set an initial value for the ignition timing SA. Next, step 1102 is performed to estimate the combustion start time θ0 and combustion end time θf in accordance with the ignition timing SA set in step 1100 or 1112 and with the map shown in FIG. 4. Step 1104 is then performed to estimate the in-cylinder pressure Pc by substituting into Equation 3 the heat release amount $PV^{\kappa}$ that is based on the in-cylinder pressure Pc measured at predetermined two points during the previous combustion cycle. Next, step 1106 is performed to calculate the indicated torque by using the estimated in-cylinder pressure Pc.

Next, step 1108 is performed to judge whether the indicated torque calculated in step 1106 coincides with the required torque calculated in step 1002. If the obtained judgment result indicates that the indicated torque does not coincide with the required torque, step 1110 is performed to advance or retard the ignition timing SA. Further, the ignition timing SA changed in this manner is used to perform steps 1102 to 1108 again. If, on the other hand, the obtained judgment result indicates that the indicated torque coincides with the required torque, step 1112 is performed to finally decide the current ignition timing SA as the estimated value.

In the routine shown in FIG. 17, step 1008 is then performed to exercise control so that the ignition timing SA for the current combustion cycle coincides with the ignition timing SA calculated in step 1006. Next, step 1010 is performed after combustion to calculate the actual indicated torque for the current combustion cycle. More specifically, the actual indicated torque is calculated by substituting into Equation 3 the heat release amount $PV^{\kappa}$ that is based on the in-cylinder pressure Pc measured at predetermined two points during the current combustion cycle.

Next, step 1012 is performed to compare the actual indicated torque for the current combustion cycle, which was calculated in step 1010, against the required torque calculated in step 1002, and calculate the deviation between the compared torque values. Step 1014 is then performed to correct the required torque for the next combustion cycle in accordance with the deviation calculated in step 1012. If, for instance, the actual indicated torque is smaller than the required torque, the required torque for the next combustion cycle is increased for correction purposes.

According to the routine shown in FIG. 17, which has been described above, the estimated in-cylinder pressure Pc acquired by Equation 3 can be used to obtain the indicated torque for the previous combustion cycle. Further, the estimated in-cylinder pressure Pc acquired by Equation 3 can be used to estimate the ignition timing SA with which the actual indicated torque for the current combustion cycle coincides with the required torque. Further, the required torque for the next combustion cycle is corrected in accordance with the actual indicated torque for the current combustion cycle, which is generated with the estimated ignition timing SA. As described above, the system according to the present embodiment can exercise control in accordance with the estimated in-cylinder pressure Pc acquired by Equation 3 so that the torque of the internal combustion engine 10 coincides with a desired required torque.

In the eighth embodiment, which has been described above, the "required torque acquisition means" according to the nineteenth aspect of the present invention is implemented when the ECU 40 performs steps 1000 and 1002; and the "control index determination means" according to the nineteenth aspect of the present invention is implemented when the ECU 40 performs steps 1004 and 1006.

NINTH EMBODIMENT

[Second Example of Torque Demand Control Based on Estimated In-Cylinder Pressure $P_{\theta}$]

A ninth embodiment of the present invention will now be described with reference to FIGS. 19 and 20.

The system according to the ninth embodiment also uses the hardware configuration shown in FIG. 1. As is the case with the eighth embodiment, the ninth embodiment uses the estimated in-cylinder pressure $P_{\theta}$ calculated by Equation 3, and exercises control so that the actual indicated torque of the internal combustion engine 10 coincides with a required torque based on the vehicle running state. The ninth embodiment differs from the eighth embodiment in that the former preestimates the torque that the internal combustion engine 10 can generate during the current combustion cycle, instead of the indicated torque for the previous combustion cycle, and estimates the ignition timing SA with which the actual indicated torque for the current combustion cycle coincides with the required torque.

Figure 19:
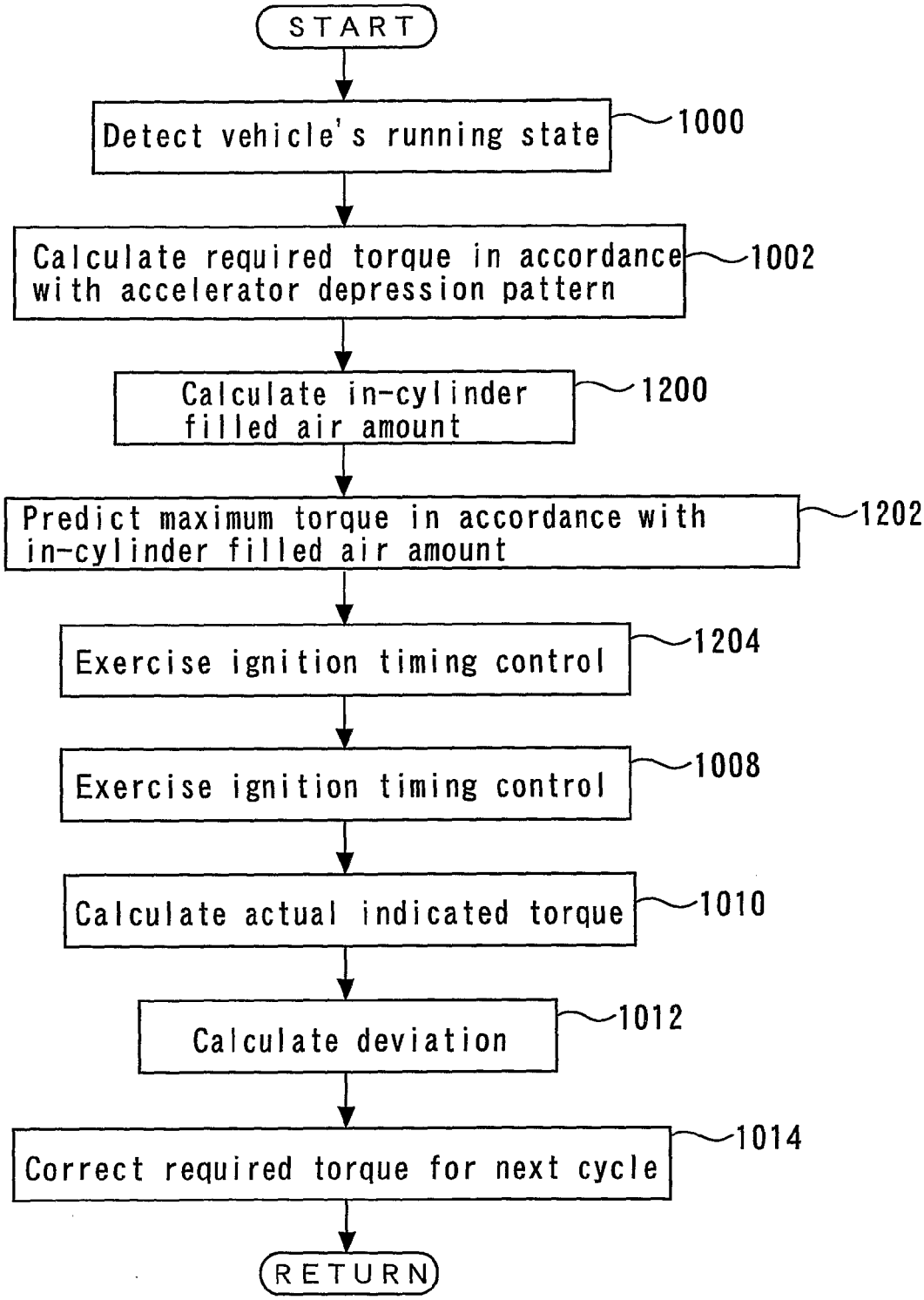
FIG. 19 is a flowchart illustrating a routine that is executed in the ninth embodiment of the present invention.

FIG. 19 is a flowchart illustrating a routine that the ECU 40 executes to implement the above functionality in accordance with the ninth embodiment. When the ninth embodiment is described with reference to FIG. 19, steps identical with those described with reference to FIG. 17 for the eighth embodiment are designated by the same reference numerals as their counterparts and omitted from the description or briefly described. In the routine shown in FIG. 19, the in-cylinder filled air amount for the current combustion cycle is calculated (step 1200) after the required torque is calculated (step 1002). More specifically, the in-cylinder filled air amount can be calculated by a relational expression (air model) that defines the relationship between the in-cylinder DJ value or the air amount and various operation parameters for the internal combustion engine 10.

Next, the maximum torque that the internal combustion engine 10 can generate during the current combustion cycle is predicted in accordance with the in-cylinder filled air amount calculated in step 1200 (step 1202). The ignition timing SA with which the actual indicated torque for the current combustion cycle coincides with the aforementioned required torque is then estimated in accordance with the predicted torque (step 1204).

Figure 20:
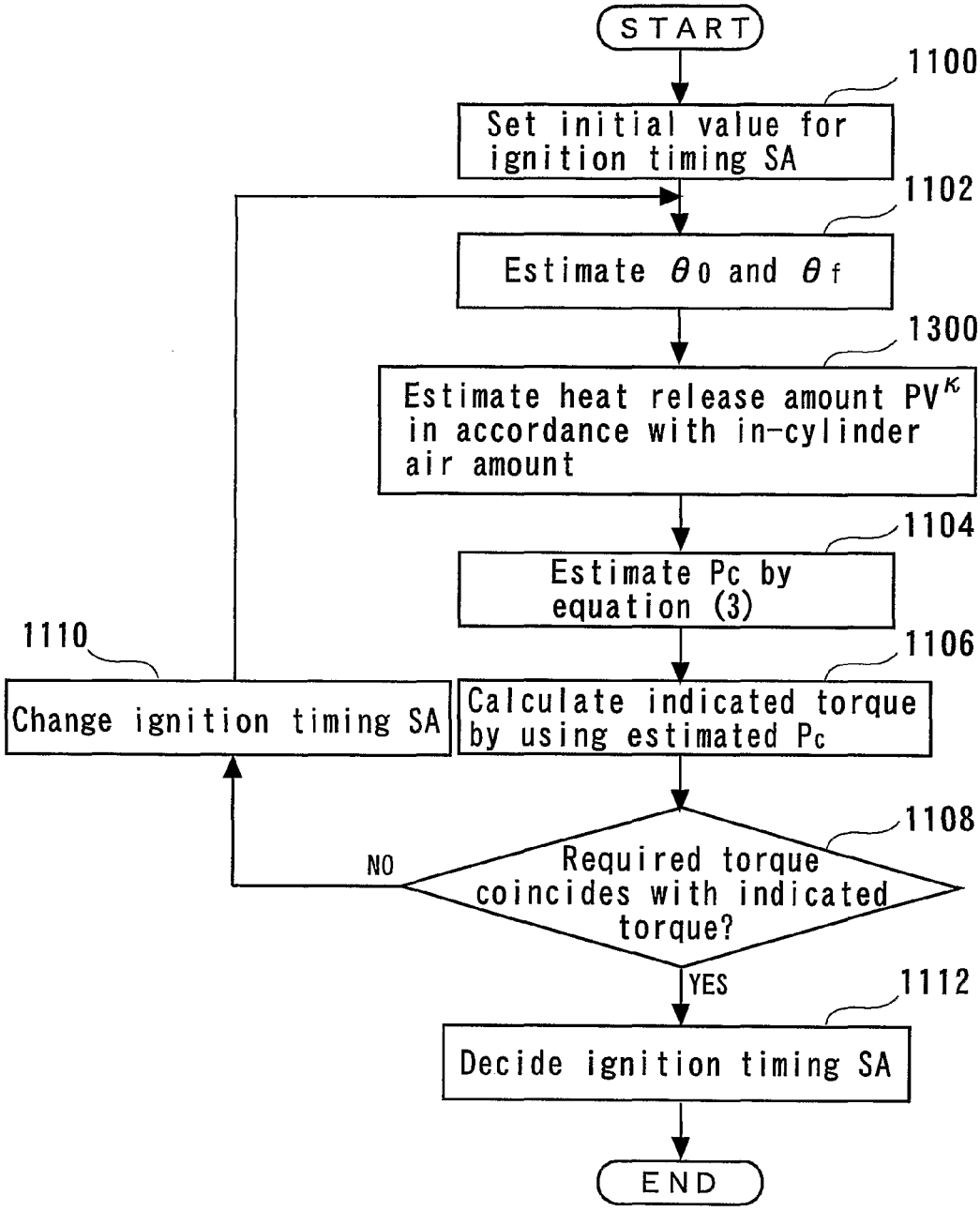
FIG. 20 is a flowchart illustrating a subroutine that is executed simultaneously with the routine shown in FIG. 19.

More specifically, the routine shown in FIG. 20 is performed in step 1204. The routine shown in FIG. 20 is basically the same as the routine shown in FIG. 18. The subsequent explanation mainly deals with the difference between these two routines. In the routine shown in FIG. 20, the heat release amount $PV^{\kappa}$ is estimated by referencing a map (not shown) in accordance with the in-cylinder air amount calculated in step 1200 (step 1300) after the combustion start time θ0 and combustion end time θf are estimated (step 1102). Next, the heat release amount $PV^{\kappa}$ is substituted into Equation 3 to estimate the in-cylinder pressure Pc (step 1104).

After the ignition timing SA is estimated by the routine shown in FIG. 20, steps 1008 to 1014 of the routine shown in FIG. 19 are sequentially performed.

According to the routine shown in FIG. 19, which has been described above, the estimated in-cylinder pressure Pc acquired by Equation 3 can be used, in accordance with the predicted torque that the internal combustion engine 10 can generate during the current combustion cycle, to estimate the ignition timing SA with which the actual indicated torque for the current combustion cycle coincides with the required torque. Further, the required torque for the next combustion cycle is corrected in accordance with the actual indicated torque for the current combustion cycle, which is generated while the estimated ignition timing SA prevails. As described above, the system according to the present embodiment can exercise control in accordance with the estimated in-cylinder pressure Pc acquired by Equation 3 so that the torque of the internal combustion engine 10 coincides with a desired required torque.

In the ninth embodiment, which has been described above, the "control index determination means" according to the nineteenth aspect of the present invention is implemented when the ECU 40 performs steps 1200 to 1204.

TENTH EMBODIMENT

[Third Example of Torque Demand Control Based on Estimated In-Cylinder Pressure $P_\theta$]

A tenth embodiment of the present invention will now be described with reference to FIG. 21.

The system according to the tenth embodiment also uses the hardware configuration shown in FIG. 1. The tenth embodiment uses the estimated in-cylinder pressure $P_\theta$ calculated by Equation 3, and determines various in-cylinder pressure determination parameters in such a manner as to obtain a required in-cylinder pressure that corresponds to the required torque.

Figure 21:
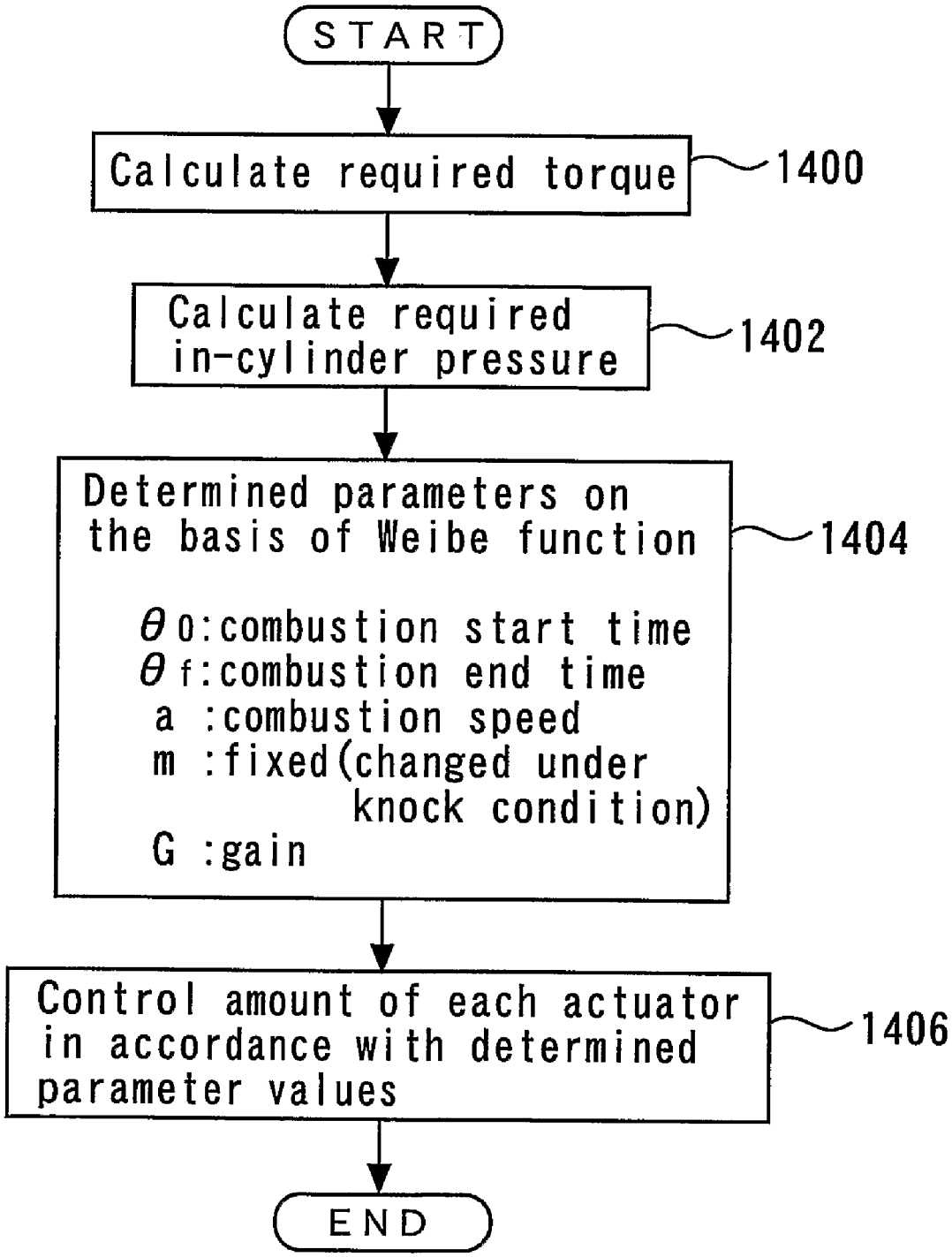
FIG. 21 is a flowchart illustrating a routine that is executed in the tenth embodiment of the present invention.

FIG. 21 is a flowchart illustrating a routine that the ECU 40 executes to implement the above functionality in accordance with the tenth embodiment. In the routine shown in FIG. 21, step 1400 is performed first to calculate the required torque for the internal combustion engine 10 in accordance with the accelerator opening, engine speed NE, and other vehicle running conditions. Next, step 1402 is performed to replace the required torque, which was calculated in step 1400, with the required in-cylinder pressure that should be generated within each cylinder to provide the required torque.

Next, step 1404 is performed to determine the parameters in Equation 3 so that the estimated in-cylinder pressure Pc equivalent to the required in-cylinder pressure calculated in step 1402 is calculated by Equation 3. The parameters are the combustion start time θ0, combustion end time θf, combustion speed a, constant m, and gain G. The gain G depends on the in-cylinder air amount and multiplies the term related to the Weibe function in Equation 3 (the term corresponding to the right-hand side of Equation 2).

Next, step 1406 is performed to determine the control amount of each actuator in accordance with the parameter values determined in step 1404 and control each actuator in accordance with the control amount. More specifically, the ignition timing SA is determined by referencing a map similar to the one shown in FIG. 4 in accordance with the combustion start time θ0 and combustion end time θf. Further, the phase control amounts VVT (valve overlap amounts) to be provided for the intake valve 22 and exhaust valve 24 by the variable valve timing mechanism are determined in accordance with the combustion speed a. Furthermore, the throttle opening TA is determined in accordance with the gain G. Here, the control amount VVT is determined according to the combustion speed a. However, the present invention is not limit to the use of such a method. An alternative is to determine the lift amount for the intake valve 22 instead of the control amount VVT or both the intake valve lift amount and control amount VVT in accordance with the combustion speed a. Although the throttle opening TA is determined according to the gain G, the present invention is not limited to the use of such a method. An alternative is to determine the opening period of the intake valve 22 instead of the throttle opening TA or both the intake valve opening period and throttle opening TA in accordance with the gain G. Here, it is assumed that the constant m is a fixed value. However, if fast burning takes place, this constant m should be increased.

The routine shown in FIG. 21, which has been described above, uses Equation 3 to determine the parameters (θ0, θf, a, etc.) necessary for acquiring the required in-cylinder pressure (required torque), and controls various actuators (electronically controlled throttle valve, variable valve timing mechanism, etc.), which control the torque (combustion) of the internal combustion engine 10, in accordance with the determined parameters. In other words, the system according to the present embodiment can exercise torque (combustion) control in accordance with a desired required torque (the required in-cylinder pressure corresponding to it) by making use of Equation 3. Further, the system according to the present embodiment can control the valve overlap amount, ignition timing SA, and the like in accordance with the parameters determined as described above without making the intake air amount excessive or insufficient and without retarding the ignition timing SA.

In the tenth embodiment, which has been described above, the "control index determination means" according to the nineteenth aspect of the present invention is implemented when the ECU 40 performs step 1404; the "required in-cylinder pressure acquisition means" according to the twentieth aspect of the present invention is implemented when the ECU 40 performs step 1402; and the "control means" according to the twenty-second aspect of the present invention is implemented when the ECU 40 performs step 1406.

The invention claimed is:

1. An internal combustion engine control apparatus comprising:

heat release amount information acquisition means for acquiring heat release amount information about an internal combustion engine;

relationship information acquisition means for acquiring relationship information, which is derived from a first relationship information and a second relationship information, and which is information about in-cylinder pressure at least one crank angle other than a combustion start time and a combustion end time, and the first relationship information indicates in-cylinder combustion ratio information about the internal combustion engine in accordance with the heat release amount information at the combustion start time, the heat release amount information at the combustion end time, and the heat release amount information at said at least one crank angle, and the second relationship information indicates the in-cylinder combustion ratio information in accordance with a Weibe function including the combustion start time, the combustion end time, and a combustion speed as a parameter; and pressure estimation means for estimating the in-cylinder pressure in accordance with the relationship information.

2. The internal combustion engine control apparatus according to claim 1, further comprising:

in-cylinder pressure detection means for detecting in-cylinder pressure, wherein the heat release amount information acquisition means acquires the heat release amount information in accordance with in-cylinder pressure and in-cylinder volume measured at two crank angles that are the combustion start time and the combustion end time; and wherein the pressure estimation means estimates in-cylinder pressure at a crank angle other than the at least two crank angles.

3. The internal combustion engine control apparatus according to claim 1, further comprising combustion information estimation means for estimating a heat release rate and/or indicated torque in accordance with an in-cylinder pressure value estimated by the pressure estimation means.

4. The internal combustion engine control apparatus according to claim 3, wherein the internal combustion engine is controlled in accordance with at least one of the in-cylinder pressure estimated by the pressure estimation means, the heat release rate estimated by the combustion information estimation means, and the indicated torque estimated by the combustion information estimation means.

5. The internal combustion engine control apparatus according to claim 4, wherein at least one of ignition timing control, fuel injection control, valve opening characteristics control, and torque control is included in the internal combustion engine control.

6. The internal combustion engine control apparatus according to claim 1, further comprising:

in-cylinder pressure detection means for detecting in-cylinder pressure; and knock information acquisition means for comparing an in-cylinder pressure value estimated by the pressure estimation means against an in-cylinder pressure value measured by the in-cylinder pressure detection means, and acquiring the information about knocking.

7. The internal combustion engine control apparatus according to claim 1, further comprising:

estimated heat release rate acquisition means for acquiring an estimated heat release rate value in accordance with the estimated in-cylinder pressure value;

actual heat release rate acquisition means for acquiring a measured heat release rate value in accordance with the measured in-cylinder pressure value; and knock information acquisition means for comparing the estimated heat release rate value against the measured heat release rate value and acquiring information about knocking.

8. The internal combustion engine control apparatus according to claim 6, wherein the knock information acquisition means acquires the information about knocking when the internal combustion engine's load factor is relatively high.

9. The internal combustion engine control apparatus according to claim 1, further comprising:

pressure record acquisition means for acquiring a record of in-cylinder pressure that is estimated by the pressure estimation means during the same combustion cycle;

maximum pressure value generation time acquisition means for acquiring the time for invoking the maximum in-cylinder pressure value from the record of the estimated in-cylinder pressure; and ignition timing control means for controlling ignition timing so that the time for invoking the maximum value coincides with the time for invoking the maximum in-cylinder pressure in a situation where the ignition timing is adjusted for MBT.

10. The internal combustion engine control apparatus according to claim 1, further comprising:

pressure record acquisition means for acquiring a record of in-cylinder pressure that is estimated by the pressure estimation means during the same combustion cycle;

maximum pressure value information acquisition means for acquiring the information about the maximum in-cylinder pressure from the record of the estimated in-cylinder pressure; and air-fuel ratio control means for exercising control so as to provide a lean or rich air-fuel ratio in accordance with the information about the maximum in-cylinder pressure.

11. The internal combustion engine control apparatus according to claim 1, further comprising:

pressure record acquisition means for acquiring a record of in-cylinder pressure that is estimated by the pressure estimation means during the same combustion cycle;

an in-cylinder pressure sensor for detecting in-cylinder pressure;

distortion detection means for comparing the record of the estimated in-cylinder pressure against a record of in-cylinder pressure measured by the in-cylinder pressure detection means, and acquiring distortion from the record of measured in-cylinder pressure; and sensor output correction means for correcting the output of the in-cylinder pressure sensor in accordance with the distortion.

12. The internal combustion engine control apparatus according to claim 1, further comprising:

pressure record acquisition means for acquiring a record of in-cylinder pressure that is estimated by the pressure estimation means during the same combustion cycle;

an in-cylinder pressure sensor for detecting in-cylinder pressure;

distortion detection means for comparing the record of the estimated in-cylinder pressure against a record of in-cylinder pressure measured by the in-cylinder pressure detection means, and acquiring distortion from the record of measured in-cylinder pressure; and sensor deterioration judgment means for determining according to the distortion whether the in-cylinder pressure sensor is deteriorated.

13. The internal combustion engine control apparatus according to claim 1, further comprising:

control basic data selection means for selecting in-cylinder pressure estimated by the pressure estimation means as an in-cylinder pressure value for use as a basis for internal combustion engine control when the engine speed is relatively high.

14. An internal combustion engine control apparatus comprising:

heat release amount information acquisition means for acquiring heat release amount information about an internal combustion engine;

ion detection means for detecting ions that are generated in a cylinder during combustion;

combustion ratio information acquisition means for acquiring in-cylinder combustion ratio information about the internal combustion engine in accordance with a value of the detected ions;

relationship information acquisition means for acquiring relationship information, which is derived from a first relationship information and the combustion ratio information in accordance with the value of the detected ions, and which is information about in-cylinder pressure at least one crank angle other than a combustion start time and a combustion end time, and the first relationship information indicates in-cylinder combustion ratio information about the internal combustion engine in accordance with the heat release amount information at the combustion start time, the heat release amount information at the combustion end time, and the heat release amount information at said at least one crank angle; and pressure estimation means for estimating the in-cylinder pressure in accordance with the relationship information.

15. The internal combustion engine control apparatus according to claim 14, wherein the heat release amount information acquisition means acquires heat release amount information in accordance with the information about an in-cylinder filled air amount; and wherein the relationship information is defined in accordance with the value of the detected ions and the heat release amount information on the basis of the in-cylinder filled air amount.

16. An internal combustion engine control apparatus comprising:

required torque acquisition means for acquiring torque required for an internal combustion engine;

heat release amount information acquisition means for acquiring heat release amount information about the internal combustion engine;

relationship information acquisition means for acquiring relationship information, which is derived from a first relationship information and a second relationship information, and which is information about in-cylinder pressure at least one crank angle other than a combustion start time and a combustion end time, and the first relationship information indicates in-cylinder combustion ratio information about the internal combustion engine in accordance with the heat release amount information at the combustion start time, the heat release amount information at the combustion end time, and the heat release amount information at said at least one crank angle, and the second relationship information indicates the in-cylinder combustion ratio information in accordance with a Weibe function including the combustion start time, the combustion end time, and a combustion speed as a parameter; and control index determination means for defining a predetermined parameter that serves as a control index for the internal combustion engine, in accordance with the required torque and the relationship information.

17. The internal combustion engine control apparatus according to claim 16, further comprising:

required in-cylinder pressure acquisition means for acquiring required in-cylinder pressure that corresponds to the required torque, wherein the control index determination means defines the predetermined parameter, which serves as a control index, in accordance with the required in-cylinder pressure and the relationship information.

18. The internal combustion engine control apparatus according to claim 16, wherein the predetermined parameter, which serves as a control index, is at least one of a combustion start time, a combustion end time, and a combustion speed.

19. The internal combustion engine control apparatus according to claim 18, further comprising:

control means for controlling at least either a valve overlap amount or ignition timing in accordance with the predetermined parameter, which is defined by the control index determination means and used as a control index.

20. An internal combustion engine control apparatus comprising:

a heat release amount information acquisition unit for acquiring heat release amount information about an internal combustion engine;

a relationship information acquisition unit for acquiring relationship information, which is derived from a first relationship information and a second relationship information, and which is information about in-cylinder pressure at least one crank angle other than a combustion start time and a combustion end time, and the first relationship information indicates in-cylinder combustion ratio information about the internal combustion engine in accordance with the heat release amount information at the combustion start time, the heat release amount information at the combustion end time, and the heat release amount information at said at least one crank angle, and the second relationship information indicates the in-cylinder combustion ratio information in accordance with a Weibe function including the combustion start time, the combustion end time, and a combustion speed as a parameter; and a pressure estimation unit for estimating the in-cylinder pressure in accordance with the relationship information.

21. An internal combustion engine control apparatus comprising:

a heat release amount information acquisition unit for acquiring heat release amount information about an internal combustion engine;

an ion detection unit for detecting ions that are generated in a cylinder during combustion;

a combustion ratio information acquisition unit for acquiring in-cylinder combustion ratio information about the internal combustion engine in accordance with a value of the detected ions;

a relationship information acquisition unit for acquiring relationship information, which is derived from a first relationship information and the combustion ratio information in accordance with the value of the detected ions, and which is information about in-cylinder pressure at least one crank angle other than a combustion start time and a combustion end time, and the first relationship information indicates in-cylinder combustion ratio information about the internal combustion engine in accordance with the heat release amount information at the combustion start time, the heat release amount information at the combustion end time, and the heat release amount information at said at least one crank angle; and a pressure estimation unit for estimating the in-cylinder pressure in accordance with the relationship information.

22. An internal combustion engine control apparatus comprising:

a required torque acquisition unit for acquiring torque required for an internal combustion engine;

a heat release amount information acquisition unit for acquiring heat release amount information about the internal combustion engine;

a relationship information acquisition unit for acquiring relationship information, which is derived from a first relationship information and a second relationship information, and which is information about in-cylinder pressure at least one crank angle other than a combustion start time and a combustion end time, and the first relationship information indicates in-cylinder combustion ratio information about the internal combustion engine in accordance with the heat release amount information at the combustion start time, the heat release amount information at the combustion end time, and the heat release amount information at said at least one crank angle, and the second relationship information indicates the in-cylinder combustion ratio information in accordance with a Weibe function including the combustion start time, the combustion end time, and a combustion speed as a parameter; and a control index determination unit for defining a predetermined parameter that serves as a control index for the internal combustion engine, in accordance with the required torque and the relationship information.

* * * * *